US008001870B2

(12) United States Patent
Saito et al.

(10) Patent No.: US 8,001,870 B2
(45) Date of Patent: Aug. 23, 2011

(54) ACCELERATOR

(75) Inventors: Takehiro Saito, Kariya (JP); Kimio Uchida, Kariya (JP); Haruhiko Suzuki, Anjo (JP); Masahiro Makino, Kariya (JP); Shigeru Hasegawa, Nagoya (JP); Hiroshi Takeyama, Obu (JP)

(73) Assignee: Denso Corporation, Kariya (JP)

( * ) Notice: Subject to any disclaimer, the term of this patent is extended or adjusted under 35 U.S.C. 154(b) by 1140 days.

(21) Appl. No.: 11/052,881

(22) Filed: Feb. 9, 2005

(65) Prior Publication Data

US 2005/0178234 A1 Aug. 18, 2005

(30) Foreign Application Priority Data

Feb. 13, 2004 (JP) ..... 2004-036605

(51) Int. Cl.
*G05G 1/30* (2008.04)

(52) U.S. Cl. ..... 74/513; 74/512; 74/514

(58) Field of Classification Search ..... 74/512, 74/513, 514, 560; 324/207.25
See application file for complete search history.

(56) References Cited

U.S. PATENT DOCUMENTS

| | | | | |
|---|---|---|---|---|
| 4,700,588 | A * | 10/1987 | Nagano | 74/594.4 |
| 5,013,930 | A * | 5/1991 | Spakowski et al. | 307/10.1 |
| 5,821,744 | A * | 10/1998 | Shinjo et al. | 324/207.2 |
| 6,070,490 | A * | 6/2000 | Aschoff et al. | 74/513 |
| 6,186,025 | B1 * | 2/2001 | Engelgau et al. | 74/512 |
| 6,330,838 | B1 * | 12/2001 | Kalsi | 74/514 |
| 6,407,543 | B1 * | 6/2002 | Hagio et al. | 324/207.25 |
| 6,414,482 | B1 * | 7/2002 | Mase | 324/207.2 |
| 6,426,619 | B1 * | 7/2002 | Pfaffenberger et al. | 324/207.2 |
| 6,505,496 | B2 * | 1/2003 | Kato et al. | 73/1.79 |
| 6,523,433 | B1 * | 2/2003 | Staker | 74/513 |
| 6,626,061 | B2 * | 9/2003 | Sakamoto et al. | 74/512 |
| 6,658,963 | B2 * | 12/2003 | Yaddehige | 74/512 |
| 6,802,202 | B2 * | 10/2004 | Kato et al. | 73/1.79 |
| 6,870,364 | B2 * | 3/2005 | Sekiya | 324/207.2 |
| 7,012,423 | B2 * | 3/2006 | Hasegawa et al. | 324/207.25 |
| 7,071,683 | B2 * | 7/2006 | Shimomura et al. | 324/207.25 |
| 2002/0186009 | A1 * | 12/2002 | Makino et al. | 324/207.25 |
| 2004/0200309 | A1 * | 10/2004 | Hasegawa et al. | 74/513 |
| 2005/0247158 | A1 * | 11/2005 | Willemsen et al. | 74/513 |

FOREIGN PATENT DOCUMENTS

| | | |
|---|---|---|
| EP | 0 748 713 | 12/1996 |
| JP | A-2000-194433 | 7/2000 |
| JP | 2003-211994 | 3/2003 |
| JP | 2003-185471 | 7/2003 |

OTHER PUBLICATIONS

Chinese Office Action dated Jun. 8, 2007 issued in corresponding Chinese Application No. 200510008137.2 with English translation.
Japanese Official Action dated Oct. 28, 2008, issued in counterpart Japanese Application No. 2004-36605 with English translation.

* cited by examiner

*Primary Examiner* — Richard W Ridley
*Assistant Examiner* — Matthew A Johnson
(74) *Attorney, Agent, or Firm* — Nixon & Vanderhye PC

(57) ABSTRACT

An accelerator capable of detecting a turning angle of an accelerator pedal with high accuracy includes a bearing part, an urging part, an accelerator pedal, a stopper, and a turning angle sensor. The accelerator pedal has a turning shaft supported by the bearing part and is turned forward when a depressing force is applied thereto and is turned reversely when the urging force of the urging part is applied thereto. The stopper abuts against the accelerator pedal to limit the reverse turn of the accelerator pedal and substantially simultaneously guides the accelerator pedal in a direction equivalent to that which the urging force is applied. The turning angle sensor detects the turning angle of the accelerator pedal.

15 Claims, 19 Drawing Sheets

ACCELERATOR

CROSS REFERENCE TO RELATED APPLICATIONS

This application is based upon and claims the benefit of priority of Japanese Patent Application No. 2004-36605, filed on Feb. 13, 2004, the contents of which are incorporated herein by reference.

FIELD OF THE INVENTION

The present invention relates to an accelerator and, more particularly, an accelerator having an abutting part for limiting reverse turning of an accelerator pedal upon closing a throttle.

BACKGROUND OF THE INVENTION

There is conventionally known an accelerator for controlling the driving state of a vehicle in response to depressing an accelerator pedal. In the accelerator, generally, an accelerator pedal whose turning shaft is supported by a bearing part is turned in a forward direction by a depressing force whereas the accelerator pedal is turned in a reverse direction by the urging force of a spring to make the accelerator pedal abut against a stopper to limit its reverse turn.

Among the accelerators like this is an accelerator of the acceleration-by-wire type in which an accelerator is not mechanically coupled to the throttle device of a vehicle as disclosed in, for example, European Patent Application Publication No. 0748713A2. In the accelerator of the acceleration-by-wire type, the turning angle of an accelerator pedal is detected by a turning angle sensor as disclosed in, for example, Japanese patent document JP-2003-185471A, and a signal indicating the detection result of the sensor is outputted to the control unit of the throttle.

FIG. 28 schematically shows a state where an accelerator pedal abuts against a stopper, that is, an accelerator pedal is totally closed in an accelerator of the conventional acceleration-by-wire type. When the accelerator pedal is totally closed, as shown in FIG. 28A, the force receiving part 102 of an accelerator pedal 101 continuously receives the urging force $F_s$ of a spring 103. For this reason, when the accelerator is left in high temperature surroundings, the force receiving part 102 and a turning shaft 104 of the accelerator pedal 101, and a stopper 105 and a bearing part 106 to which loads are applied by these elements 102 and 104 undergo plastic deformation such as creep. In particular, this plastic deformation becomes large when these elements 102, 104, 105 and 106 are made of resin. When this plastic deformation occurs, as shown in FIG. 28B, the force receiving part 102 of the accelerator pedal 101 is shifted in position in a direction in which the urging force $F_s$ is applied, whereas the turning shaft 104 of the accelerator pedal 101 is shifted in position in a direction opposite to the direction in which the urging force $F_s$ is applied. In this manner, the force receiving part 102 and the turning shaft 104 are shifted in position in opposite directions, whereby the accelerator pedal is turned although the accelerator pedal is not depressed. Hence, as a result, the output signal of the turning angle sensor indicates an erroneous turning angle.

FIGS. 29A and 29B show a state where the accelerator pedal is totally closed in the turning angle sensor disclosed in Japanese patent document JP-2003-185471A. Here, in FIGS. 29A and 29B, a three-dimensional rectangular coordinate is defined in which a Z direction is aligned with the axial direction of a turning shaft of an accelerator pedal (direction vertical to the surface of paper). When the accelerator pedal is totally closed, as shown in FIG. 29A, there is a case where core parts 112, 113, which are arranged side by side in an X direction, of a core 110 are shifted in position from each other in a Y direction because of assembly tolerances. When the core parts 112, 113 are shifted in position from each other, the core part 112 is closest to one of the plane portions 122, 123 of yokes 120, 121 which face each other in parallel in the Y direction across the core 110 and the core part 123 is closest to the other of the plane portions 122, 123. As a result, magnetic flux passes through a magnetic gap formed between the core parts 112, 113 which are closest to the plane portions 122, 123, respectively, to bring magnetic resistance into unbalance, whereby magnetic flux flows through a Hall device 111 sandwiched between the core parts 112, 113. Further, when the turning shaft is shifted in position in the Y direction in this state by the above-described plastic deformation and the like as shown in FIG. 29B, the yokes 120, 121 fixed to the turning shaft are relatively shifted in position in the Y direction with respect to the core 110 fixed to the bearing part. As a result, the magnetic gaps between the plane parts 122, 123 and the core part 112, 113 closest to them are changed in width, respectively, to bring magnetic resistance in the core 110 into large imbalance, which results in passing more magnetic flux through the Hall device 111. Hence, although the accelerator pedal is not turned, the output signal of the Hall device 111, that is, the output signal of the turning angle sensor varies and hence the output signal indicates an erroneous turning angle.

SUMMARY OF THE INVENTION

The object of the invention is to provide an accelerator capable of detecting the turning angle of an accelerator pedal.

Accordingly, when an accelerator is left in high temperature surroundings in a state where an accelerator pedal abuts against a stopper, there is a possibility that the turning shaft of an accelerator pedal (hereinafter simply referred to as turning shaft) continuously receiving the urging force of an urging part (hereinafter simply referred to as urging force) and a bearing supporting the turning shaft develop plastic deformation. However, according to one aspect of the present invention, the stopper abutting against the accelerator pedal also guides the accelerator pedal along a direction in which the urging force is applied, the direction in which the turning shaft is shifted in position is limited to the direction in which the urging force is applied. In addition, at this time, a portion that receives the urging force in the accelerator pedal is displaced in the direction in which the urging force is applied, so the turning angle of the accelerator pedal is not varied. In this manner, it is possible to prevent the turning angle of the accelerator pedal (hereinafter simply referred to as turning angle) from varying in spite of the fact that the accelerator pedal is not depressed. Hence, the turning angle sensor can detect a correct turning angle, which results in enhancing the detection accuracy of the turning angle.

According to another aspect of the present invention, the stopper is put into line contact with the accelerator pedal, so the contact area between the stopper and the accelerator pedal becomes small. With this, it is possible to prevent a position where the stopper abuts against the accelerator pedal from being changed by the plastic deformation of the stopper and/or the accelerator pedal.

Alternatively, the stopper may be put into surface contact with the accelerator pedal.

Here, a three-dimensional rectangular coordinate system is defined in which a Z direction is aligned with the axial direction of the turning shaft.

According to other aspects of the present invention, there is a possibility that when the accelerator pedal is totally closed, that is, when the accelerator pedal abuts against the stopper, two first magnetic bodies of a magnetism detecting part that are arranged side by side in the X direction of the rectangular coordinate system are shifted in position from each other in the Y direction of the rectangular coordinate system because of assembly tolerances. Since the respective facing portions of two second magnetic bodies facing each other across the magnetism detecting part in the Y direction of the rectangular coordinate system in a magnetic field forming part are parallel to the X axis of the rectangular coordinate system, when the accelerator pedal is totally closed in the case where the two first magnetic bodies are shifted in position from each other, one first magnetic body and the other first magnetic body are brought to positions closest to one facing portion and the other facing portion, respectively. As a result, magnetic flux passes through the magnetic gaps (hereinafter simply referred to as magnetic gap) formed between the respective facing portions and the closest first magnetic bodies, whereby magnetic flux slightly flows through a electromagnetic conversion device sandwiched between the two first magnetic bodies. However, the magnetism detecting part and the magnetic field forming part are fixed to one of the bearing part and the turning shaft and the other of them, respectively, and the X axis of the rectangular coordinate system is along the direction in which the turning shaft is shifted in position when the accelerator pedal is totally closed. Hence, even when the turning shaft is shifted in position when the accelerator pedal is totally closed, the width of the magnetic gap is not substantially varied. For this reason, the magnetic flux flowing through the electromagnetic conversion device is not varied, either. In this manner, it is possible to prevent magnetic flux passing through the electromagnetic conversion device from being varied in spite of the fact that the accelerator pedal is not turned. Therefore, a correct turning angle can be detected on the basis of the output signal of the electromagnetic conversion device, which results in enhancing the detection accuracy of the turning angle.

In this regard, as for the electromagnetic conversion device, it is possible to construct the electromagnetic conversion device in such a way that magnetism is detected by a Hall device or by a magnetoresistance device to output a signal indicating its detection result.

According to yet another aspect of the present invention, each of the first magnetic bodies is formed in the same shape. Hence, it is possible to form the first magnetic bodies with ease and to obtain constant characteristics independent of the direction of turn.

According to still another aspect of the present invention, at least one of the bearing part and the turning shaft is formed of resin. Hence, it is possible to reduce weight and cost and, at the same time, to secure high detection accuracy independent of the plastic deformation and/or the displacement of the turning shaft.

Other features and advantages of the present invention will be appreciated, as well as methods of operation and the function of the related parts from a study of the following detailed description, appended claims, and drawings, all of which form a part of this application. In the drawings:

DETAILED DESCRIPTION OF THE PREFERRED EMBODIMENTS

A plurality of preferred embodiments of the invention will be described below on the basis of the drawings.

Figure 2:
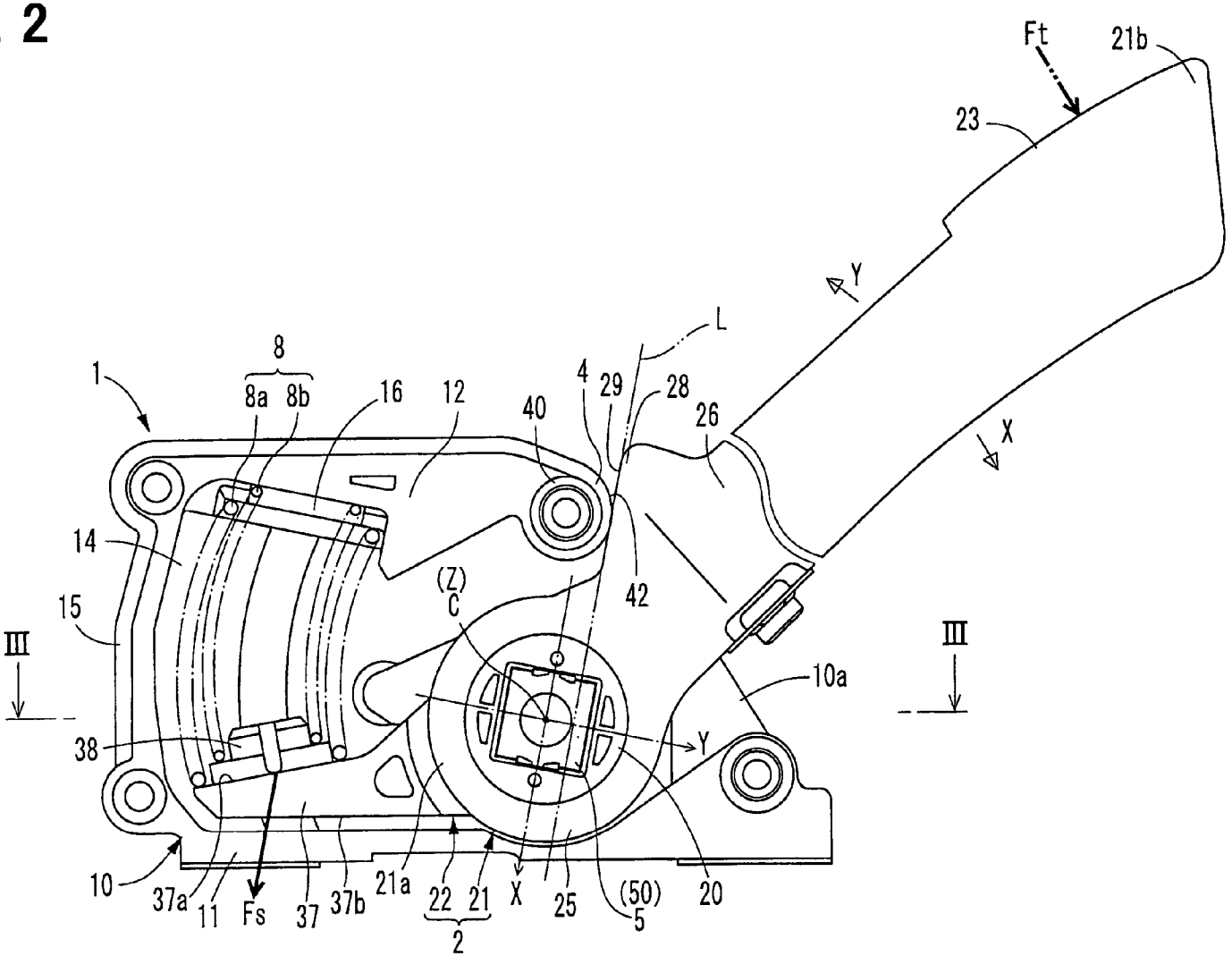
FIG. 2 is a side view of the accelerator of FIG. 1.
Figure 3:
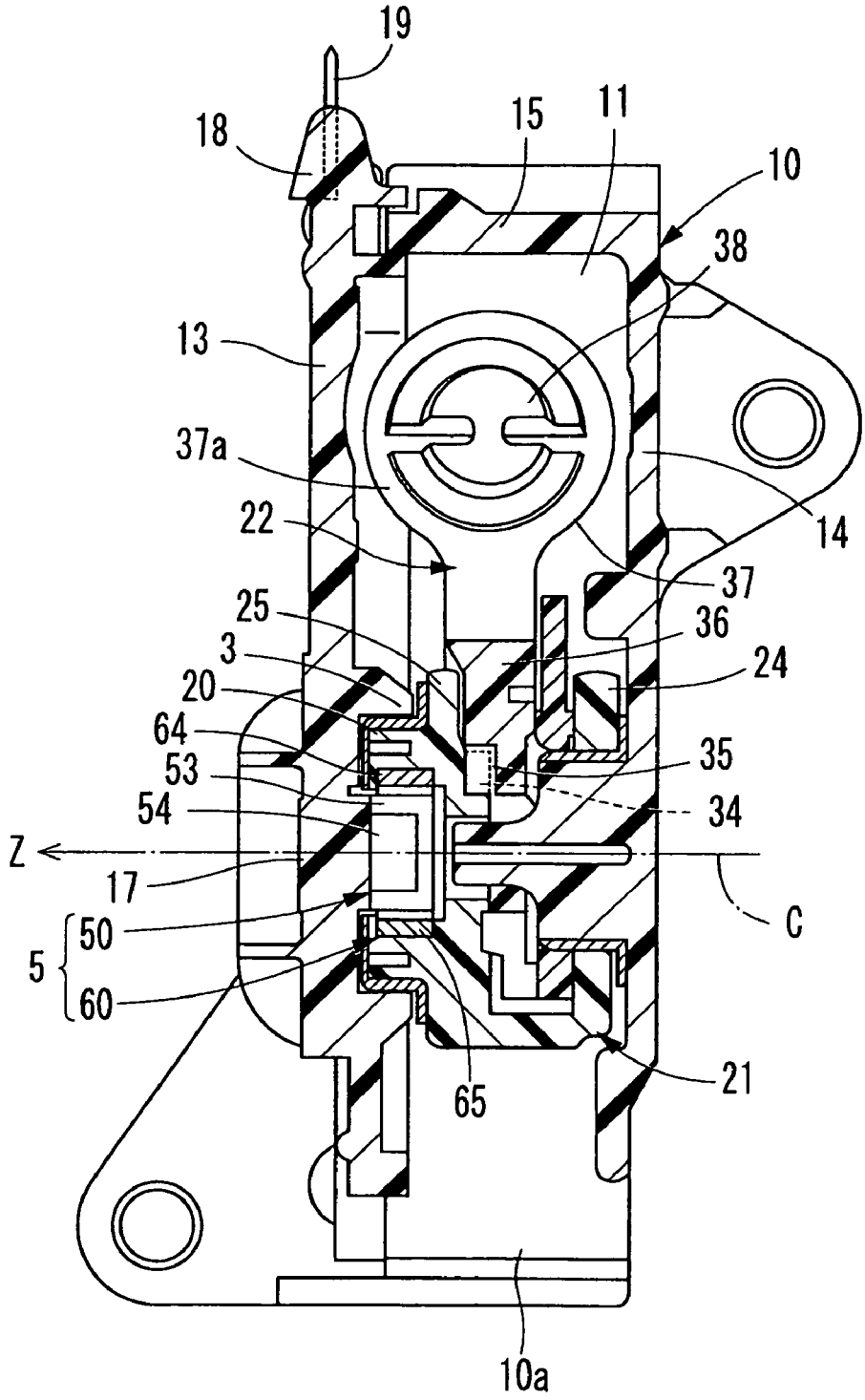
FIG. 3 is a cross-sectional front view of the accelerator of FIG. 1 taken through line III-III of FIG. 2.

An accelerator 1 in accordance with the first embodiment is shown in FIG. 2 and FIG. 3. The accelerator 1 is mounted in a vehicle and controls the driving state of the vehicle in response to a driver depressing an accelerator pedal 2. The accelerator 1 adopts an acceleration-by-wire system in which the accelerator pedal 2 is not mechanically coupled to a throttle device of the vehicle. Instead, the accelerator 1 detects the turning angle of the accelerator pedal 2 with a turning angle sensor 5 and outputs a signal indicating the detection result of the turning angle sensor 5 to an electronic control unit (ECU) of a vehicle engine. The ECU then controls the throttle device on the basis of the turning angle of the accelerator pedal 2 derived from the output signal of the turning angle sensor 5.

A housing 10 for supporting the accelerator pedal 2 is formed of resin in the shape of a box defining an opening 10*a*. The housing 10 has a bottom plate 11, a top plate 12, two side plates 13, 14, and a coupling plate 15.

The bottom plate 11 is fixed to the vehicle by bolts or the like and faces the top plate 12. In the top plate 12, a stopper 4 is formed integrally with an edge portion forming the opening 10*a*. In the inner wall of the top plate 12, a fixing hole 16, the diameter of which becomes smaller as its depth becomes, larger is formed.

The side plates 13, 14 are coupled vertically to the bottom plate 11 and the top plate 12 and face each other. One side plate 13 is removably attached to the housing 10. A cylindrical bearing 3 is mounted on the inner wall of the side plate 13. A portion for closing a base end side of the bearing 3 in the side plate 13 forms a support portion 17 for supporting a magnetism detecting part 50 of the turning angle sensor 5 on the inner peripheral side of the bearing 3. The above-described side plate 13 having the bearing 3 may also be referred to hereinafter as a "bearing part." A terminal 19 for electrically connecting the turning angle sensor 5 and the ECU is embedded in a connector 18 formed integrally with the outer wall of the side plate 13.

The coupling plate 15 is arranged in such a way as to couple one end of the bottom plate 11 to one end of the top plate 12 and in such a way as to couple one end of the side plate 13 to one end of the side plate 14. The opening 10*a* of the housing 10 is formed between the other end of the bottom plate 11 and the other end of the top plate 12 and between the other end of the side plate 13 and the other end of the side plate 14 and faces the coupling plate 15.

The accelerator pedal 2 has a turning shaft 20 supported by the bearing 3 of the housing 10 and can be freely turned in both forward and reverse directions around the axis C of the turning shaft 20. In FIG. 2, reference symbol X denotes the forward turning side of the accelerator pedal 2 and Y denotes the reverse turning side of the accelerator pedal 2.

To be more specific, the accelerator pedal 2 is constructed of a pedal arm 21 and a pedal rotor 22 which are integrally turned in both forward and reverse directions.

The pedal arm 21 is formed of resin in the shape of a bar. The pedal arm 21 includes two end portions 21*a*, 21*b*. The one end portion 21*a* has the turning shaft 20 and is received in the housing 10. The other end portion 21*b* extends through the opening 10*a* outside the housing 10.

The end portion 21*b* of the pedal arm 21 has a depressing portion 23 to be depressed by a driver. The driver applies a depressing force $F_t$ to the depressing portion 23 to turn the pedal arm 21 and the pedal rotor 22 in a forward direction. The above-described depressing portion 23 that receives the depressing force $F_t$ may also be referred to hereinafter as a "first force receiving part."

The pedal arm 21 has two sidewalls 24, 25 at the end portion 21*a*. The sidewalls 24, 25 face each other in parallel in the axial direction of the turning shaft 20. The turning shaft 20 is formed integrally with the sidewall 25 directly facing the side plate 13. The turning shaft 20 protrudes cylindrically in the axial direction of the turning shaft 20 from the wall surface on the side plate 13 side of the sidewall 25. The turning shaft 20 is inserted into an inner peripheral side of the bearing 3 of the side plate 13 and is rotatably supported by the bearing 3. In this embodiment, there is a small clearance between the outer peripheral surface of the turning shaft 20 and the inner peripheral surface of the bearing 3. The turning shaft 20 is allowed to shift in a radial direction within the clearance.

The pedal arm 21 has an abutting portion 28 at a position between the turning shaft 20 and the depressing portion 23 in the longitudinal direction. The abutting portion 28 protrudes in a reverse turn direction from a main body 26 of the pedal arm 21 for abutting against the stopper 4. When the depressing force $F_t$ is applied to the depressing portion 23 to separate the abutting portion 28 from the stopper 4, the pedal arm 21 and the pedal rotor 22 are allowed to turn in both forward and reverse directions. In contrast to this, when the abutting portion 28 of the pedal arm 21 rotating in the reverse direction abuts against the stopper 4, the pedal arm 21 and the pedal rotor 22 are prohibited from turning further in the reverse direction. In other words, the accelerator pedal 2 constructed of the pedal arm 21 and the pedal rotor 22 are limited in reverse turn by the pedal arm 21 abutting against the stopper 4. At this time, the accelerator pedal 2 is stopped at a totally closed position. In the following description, the situation that occurs when the abutting portion 28 abuts against the stopper 4 is referred to as "when the pedal is totally closed."

The pedal rotor 22 is formed of resin and is received in the housing 10. The pedal rotor 22 has a disk-shaped turning portion 36 and both sides of the turning portion 36 are sandwiched between both sidewalls 24, 25 of the pedal arm 21. A plurality of helical teeth 35 are formed on the side surface of side wall 25 side of the turning portion 36. The plurality of helical teeth 35 are formed at equal intervals around the axis C of the turning shaft 20. A plurality of helical teeth 34 are formed on a wall surface of the turning portion side of the side wall 25 of the pedal arm 21. The plurality of helical teeth 34 are also formed at equal intervals around the axis C of the turning shaft 20 and are engaged with any one of the helical teeth 35 that face the helical teeth 34 in the axial direction of the turning shaft 20. With this engagement, the pedal arm 21 and the pedal rotor 22 can turn in combination in the same direction. For example, when the depressing portion 23 of the pedal arm 21 receives the depressing force Ft, the pedal rotor 22 turns together with the pedal arm 21.

The pedal rotor 22 has a plate-shaped retaining portion 37. The retaining portion 37 protrudes in a tangential direction from an outer peripheral edge portion of the turning portion 36. A protruding portion 38 protruding from a plate surface 37*a* facing the top plate 12 side of the retaining portion 37 is formed in the shape of a stepped circular column whose diameter becomes smaller toward its protruding tip end. In this embodiment, the retaining portion 37 is designed to prevent a plate surface 37*b* facing the bottom plate 11 side of the retaining portion 37 from being put into contact with the bottom plate 11 at an arbitrary turn position of the pedal rotor 22.

A double coil spring 8, which may also be referred to hereinafter as an "urging member," is constructed of a combination of two cylindrical compression coil springs having nearly constant diameters in the axial direction. In the double coil spring 8, an outside coil 8*a* is formed of a larger diameter than an inside coil 8*b* and is arranged coaxially outside the inside coil 8*b*. Ends of the outside coil 8*a* and the inside coil 8*b* are fixed to the fixing hole 16 of the top plate 12. Opposite ends of the outside coil 8*a* and the inside coil 8*b* are fixed to the protruding portion 38 of the retaining portion 37. When the outside coil 8*a* and the inside coil 8*b* are compressed in the axial direction between the top plate 12 and the retaining portion 37, they generate restoring forces. Further, in this embodiment, the outside coil 8*a* and the inside coil 8*b* are curved away from the turning shaft. This curving of the outside coil 8*a* and the inside coil 8*b* also generates another restoring force. Hence, the double coil spring 8 applies the resultant force of the restoring forces, generated by the outside coil 8*a* and the inside coil 8*b*, as an urging force $F_s$ to the retaining portion 37, as shown in FIG. 2. At this time, the urging force $F_s$ is applied to the retaining portion 37 in such a way as to turn the pedal rotor 22 and the pedal arm 21 in the reverse direction. The above-described retaining portion 37 for receiving the urging force $F_s$ may also be referred to hereinafter as a "second force receiving portion."

Next, the stopper 4 and the abutting portion 28 of the pedal arm 21 will be described in detail.

The stopper 4 protrudes from the edge portion of the top plate 12 toward the abutting portion 28 of the pedal arm 21. A metal core part 40 for reinforcement is embedded in the stopper 4 that is formed of resin integrally with the top plate 12. A tip surface on the protruding side of the stopper 4 forms a curved convex surface 42 whose contour in a section vertical to the turning shaft 20 (hereinafter referred to as a "section vertical to axis") is circular.

The abutting portion 28 has a flat surface 29 facing the stopper 4. The abutting portion 28 is in line contact with the curved convex surface 42 of the stopper 4 on this flat surface 29. Since this line contact decreases the contact area between the stopper 4 and the abutting portion 28, it is possible to prevent these elements 4, 28 from developing plastic deformation such as creep, which can prevent a change in a position where they abut against each other. The contour in a section vertical to axis of the flat surface 29 when the pedal is totally closed overlaps an imaginary straight line along a direction in which the urging force $F_s$ is applied to the retaining portion 37. For this reason, when the pedal is totally closed, the abutting portion 28 can slide with respect to the curved convex surface 42 along the direction in which the urging force $F_s$ is applied to the retaining portion 37. In other words, when the pedal is totally closed, the stopper 4 can guide the abutting portion 28 along the direction in which the urging force $F_s$ is applied to the retaining portion 37.

Figure 1:
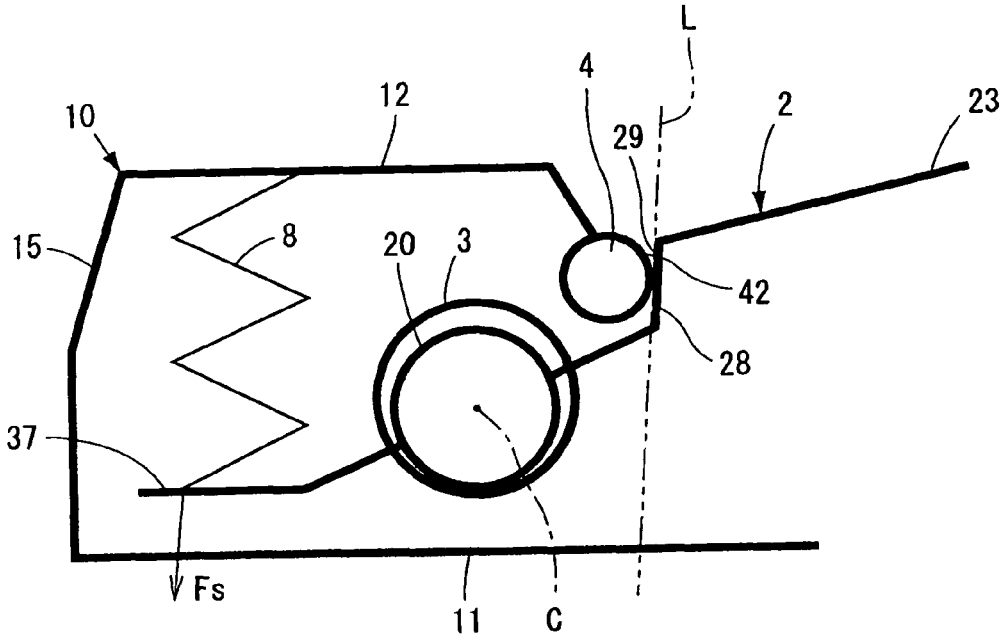
FIG. 1 is a side schematic view of an accelerator in accordance with a first embodiment of the present invention.

FIG. 1 schematically shows the state of the accelerator 1 when the pedal is totally closed. When the accelerator 1 is left in high temperature surroundings when the pedal is totally closed as shown in FIG. 1, there is a possibility that plastic deformation such as creep may develop in the turning shaft 20 of the accelerator pedal 2 whose retaining portion 37 continuously receives the urging force $F_s$ and in the bearing 3 for supporting the turning shaft 20. However, in this embodiment, the abutting portion 28 is guided by the stopper 4 along the direction in which the urging force $F_s$ is applied to the retaining portion 37, so that the direction in which the turning shaft 20 is shifted in position with respect to the bearing 3 is limited to the direction in which the urging force $F_s$ is applied. Further, at this time, the retaining portion 37 for receiving the urging force $F_s$ is displaced in the direction in which the urging force $F_s$ is applied, so that the turning angle of the accelerator pedal 2 is not varied. Hence, it is possible to prevent the output signal of the turning angle sensor 5 from being varied by plastic deformation of the turning shaft 20 and/or the bearing 3 irrespective of the accelerator pedal 2 being not depressed.

Next, the turning angle sensor 5 will be described in detail.

Here, as shown in FIGS. 1 and 2, a three-dimensional rectangular coordinate system is defined in which a Z direction is aligned with the axial direction of the turning shaft 20 and where an X direction is along the direction in which the urging force $F_s$ is applied to the retaining portion 37. In this embodiment, it is assumed that this rectangular coordinate system is fixed to the turning shaft 20. That is, as is clear from the coordinate axes shown in FIGS. 4A and 5A, this rectangular coordinate system turns with the turning shaft 20 around the Z axis aligned with the axis C of the turning shaft 20. In the following description, the X direction, Y direction, and Z direction of the rectangular coordinate system are simply referred to as X direction, Y direction, and Z direction and the X axis, Y axis, and Z axis of the rectangular coordinate system are simply referred to as X axis, Y axis, and Z axis.

As shown in FIG. 3, the turning angle sensor 5 has a magnetism detecting part 50 and a magnetic field forming part 60.

Figure 4A:
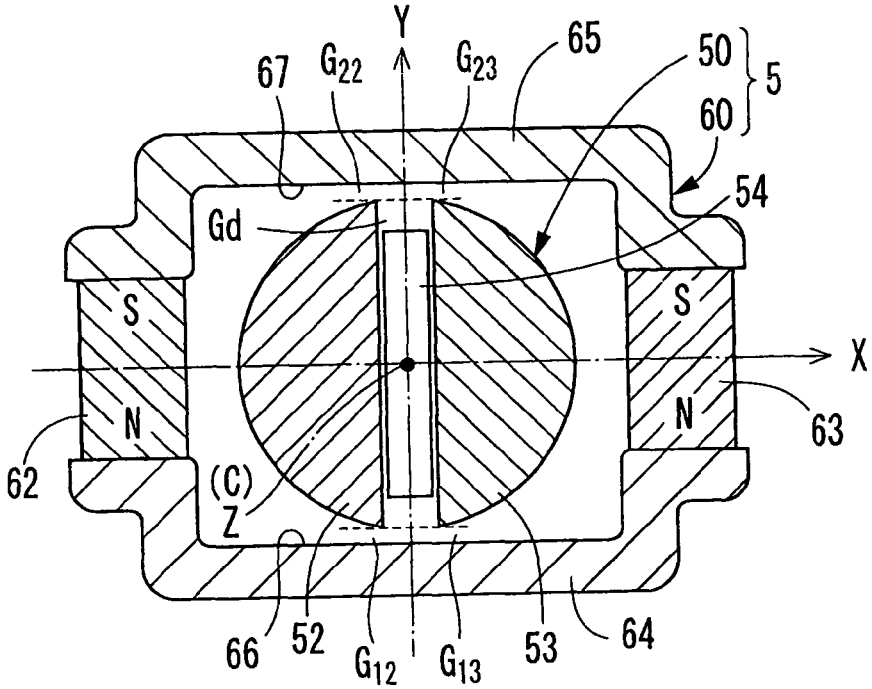
FIG. 4A is a cross-sectional side view of an ideal turning angle sensor of the present invention in a first position.
Figure 4B:
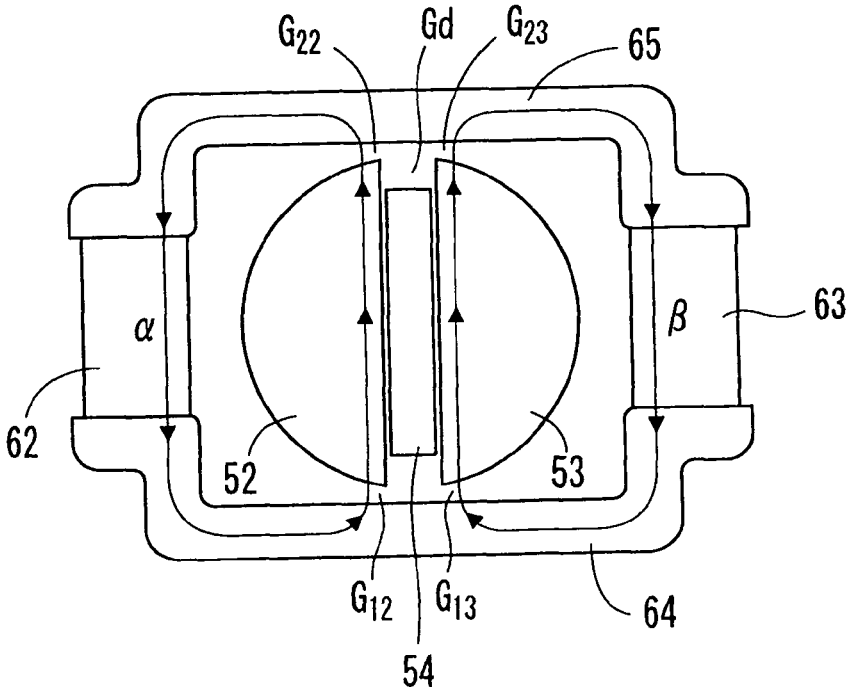
FIG. 4B is a side schematic view illustrating magnetic flux flowing through the turning angle sensor of FIG. 4A.

The magnetism detecting part 50 is fixed to the support part 17 of the side plate 13 coaxially with the bearing 3. As shown in FIGS. 4A and 4B, the magnetism detecting part 50 is constructed of two stators 52, 53 and a electromagnetic conversion device 54. The stators 52, 53, which may also be referred to as the first magnetic bodies, are formed of magnetic material such as iron in the same shape. The stators 52, 53 in this embodiment are formed in the shape of a semicircular plate when viewed from the Z direction. The stators 52, 53 are arranged in such a way that they are rotationally symmetric with respect to the Z axis and that they are arranged side by side in the X direction when the pedal is totally closed as shown in FIGS. 4A and 4B and face each other across a magnetism detection gap $G_d$. The electromagnetic conversion device 54 is a combination of a commonly known Hall device and a signal processing circuit such as an amplifier and is arranged in the magnetism detection gap $G_d$. The direction of magnetism detection of the electromagnetic conversion device 54 is set in the direction of width of the magnetism detection gap $G_d$, that is, the direction in which the stators 52, 53 are arranged side by side. The electromagnetic conversion device 54 detects magnetic flux density passing through itself, to be more specific, magnetic flux density in the direction of magnetism detection and outputs a voltage signal responsive to the detected magnetic flux density to the ECU. This signal becomes the output signal of the turning angle sensor 5.

The magnetic field forming part 60 is coaxially fixed to the turning shaft 20 and can be turned integrally with the turning shaft 20 in both forward and reverse directions. The magnetic field forming part 60 is constructed of two magnets 62, 63 and two yokes 64, 65. The magnets 62, 63 are permanent magnets of the same shape. The magnets 62, 63 are arranged in such a way that they have line symmetry with respect to the Y axis and face each other in the X direction across the magnetism detecting part 50. The yokes 64, 65, which may also be referred to hereinafter as the second magnetic bodies, are formed of magnetic material such as iron in the same shape. The yokes 64, 65 in this embodiment are U-shaped when viewed from the Z direction. The yokes 64, 65 are arranged in such a way that they have line symmetry with respect to the X axis and face each other across the magnetism detecting part 50. The facing portions 66, 67 that face each other in the Y direction in the yokes 64, 65 are shaped in flat surfaces parallel to the X axis and parallel to each other. The facing portions 66, 67 are formed in such a way that they are not put into contact with the magnetism detecting part 50 at an arbitrary turn position of the turning shaft 20. One yoke 64 magnetically couples the same N magnetic poles of the magnets 62, 63 fixed to its both ends. The other yoke 65 magnetically couples the same S magnetic poles of the magnets 62, 63 fixed to its both ends.

Figure 5A:
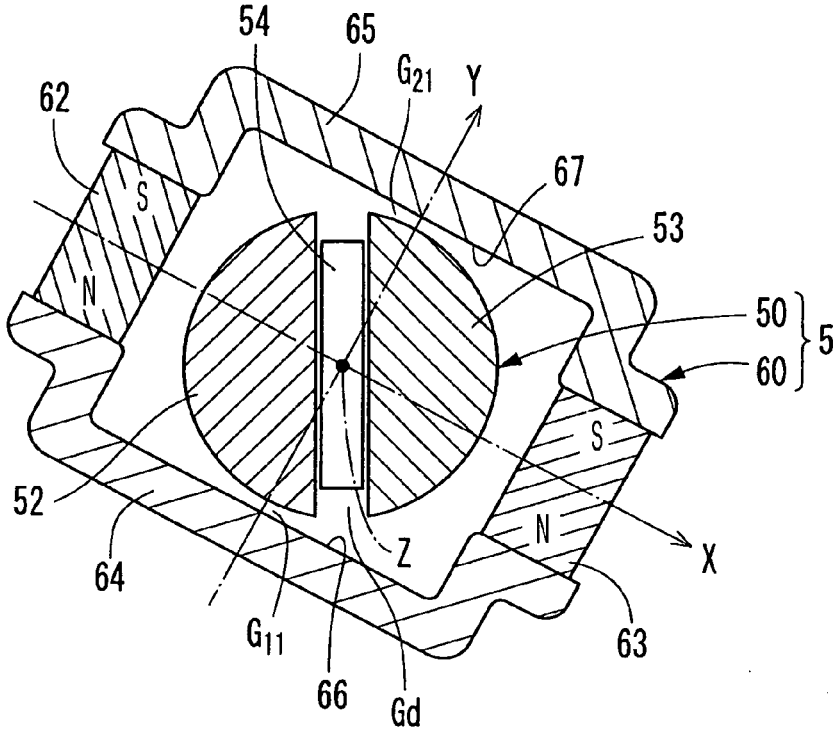
FIG. 5A is a cross-sectional side view of the turning angle sensor of FIG. 4A in a second position.
Figure 5B:
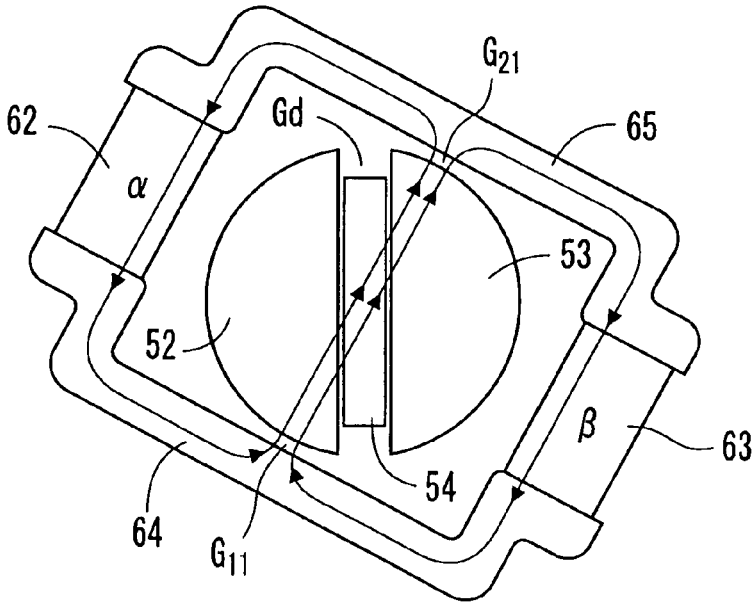
FIG. 5B is a side schematic view illustrating magnetic flux flowing through the turning angle sensor of FIG. 5A.

FIGS. 5A and 5B show a state where the accelerator pedal 2 is depressed to separate the abutting portion 28 from the stopper 4. At this time, the stator 52 is brought to a position closest to the facing portion 66 to form a magnetic gap $G_{11}$ between the facing portion 66 and the stator 52. Further, the stator 53 is brought to a position closest to the facing portion 67 to form a magnetic gap $G_{21}$ between the facing portion 67 and the stator 53. With this, a main magnetic circuit for flowing magnetic fluxes α, β is formed in the turning angle sensor 5, as schematically shown in FIG. 5B. Here, the magnetic flux α flows from the magnet 62 and passes through the yoke 64, the magnetic gap $G_{11}$, the stator 52, the magnetism detection gap $G_d$, the stator 53, the magnetic gap $G_{21}$, the yoke 65 and then returns to the magnet 62. Further, the magnetic flux β flows from the magnet 63 and passes through the yoke 64, the magnetic gap $G_{11}$, the stator 52, the magnetism detection gap $G_d$, the stator 53, the magnetic gap $G_{21}$, the yoke 65 and then returns to the magnet 63. When the magnetic fluxes α, β flow in this manner, magnetic flux flows through the electromagnetic conversion device 54 and the voltage of output signal of the electromagnetic conversion device 54 becomes a value nearly proportional to the turning angle of the turning shaft 20.

FIGS. 4A and 4B show an ideal state when the pedal is totally closed. In this ideal state when the pedal is totally closed, both of the stators 52, 53 are brought to the positions closest to the respective facing portions 66, 67, whereby nearly equal magnetic gaps $G_{12}$, $G_{13}$ are formed between the facing portion 66 and the stators 52, 53 and nearly equal magnetic gaps $G_{22}$, $G_{23}$ are similarly formed also between the facing portion 67 and the stators 52, 53. With this, in the turning angle sensor 5, as schematically shown in FIG. 4B, the main magnetic circuit flowing magnetic fluxes α, β is formed. Here, the magnetic flux α flows from the magnet 62 and passes through the yoke 64, the magnetic gap $G_{12}$, the stator 52, the magnetism detection gap $G_{22}$, and the yoke 65 in sequence and then returns to the magnet 62. Further, the magnetic flux β flows from the magnet 63 and passes through the yoke 64, the magnetic gap $G_{13}$, the stator 53, the magnetic gap $G_{23}$, and the yoke 65 in sequence and then returns to the magnet 63. When the magnetic fluxes α, β flow in this manner, magnetic flux does not flow through the electromagnetic conversion device 54 and hence the voltage of output signal of the electromagnetic conversion device 54 becomes a minimum value.

Figure 6A:
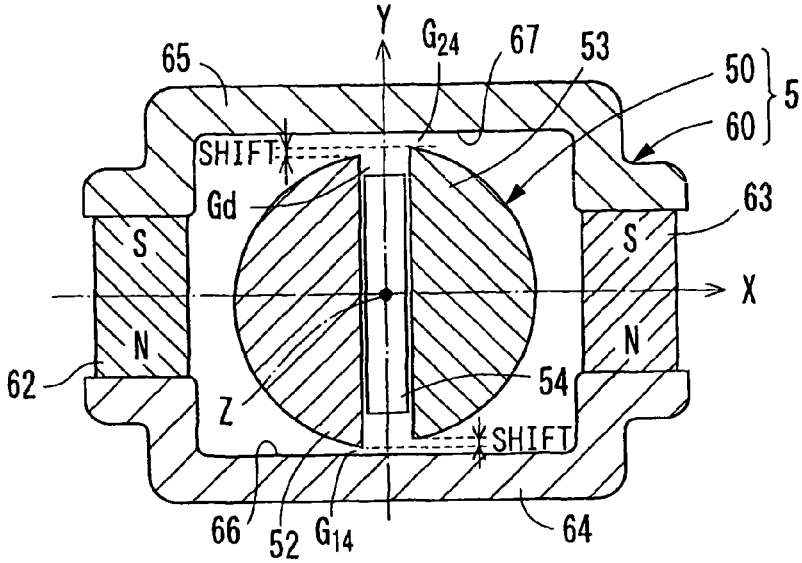
FIG. 6A is a cross-sectional view of a less than ideal turning angle sensor of the present invention.
Figure 6B:
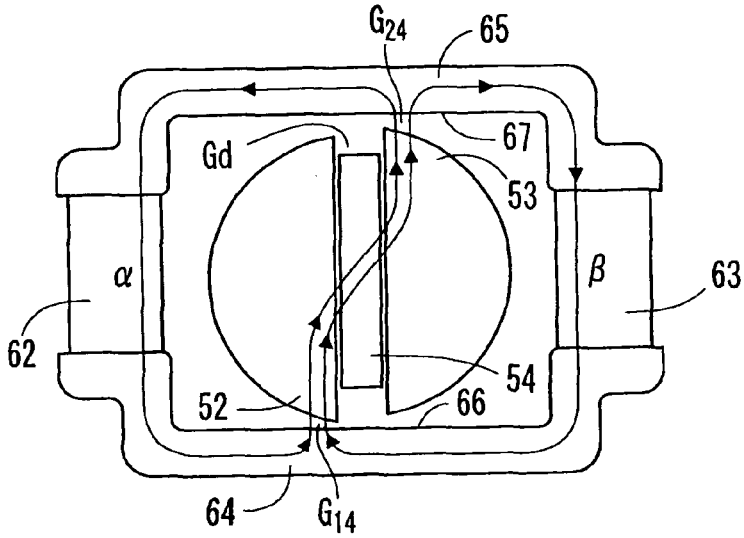
FIG. 6B is a side schematic view illustrating magnetic flux flowing through the turning angle sensor of FIG. 6A.
Figure 6C:
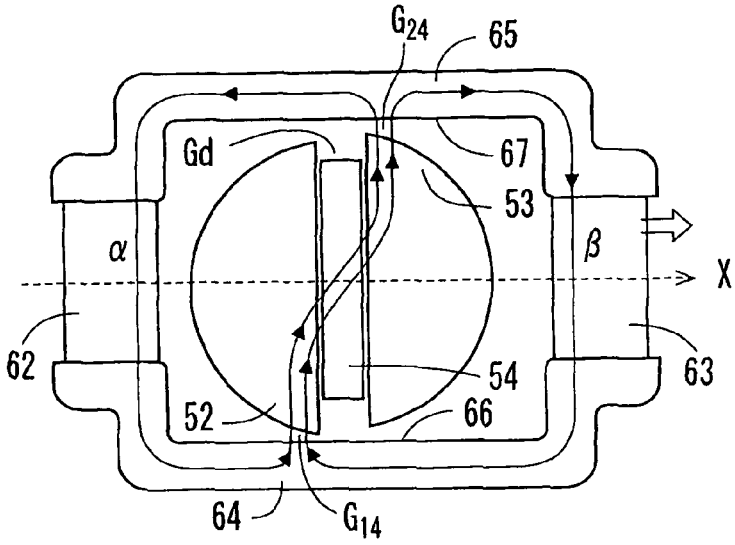
FIG. 6C is a side schematic view illustrating magnetic flux flowing through the turning angle sensor of FIG. 6A.

However, in reality, the stators 52, 53 are apt to be shifted in position in a lateral direction and in a vertical direction because of the assembly tolerances. In this case, when the pedal is totally closed, as shown in FIG. 6A, the stators 52, 53 are brought into positions shifted from each other in the Y direction. For this reason, one of the stators 52, 53 is brought to a position closest to the facing portion 66 (in FIG. 6, the stator 52 is brought to a position closest to the facing portion 66) whereas the other of the stators 52, 53 is brought to a position closest to the facing portion 67 (in FIG. 6, the stator 53 is brought to a position closest to the facing portion 67.) With this, the magnetic gaps G14, G24 are formed between the facing portion 66, 67 and the stators 52, 53 closest thereto, whereby the main magnetic circuit flowing the fluxes α, β is formed in the turning angle sensor 5 as schematically shown in FIG. 6B. Here, the magnetic flux α flows from the magnet 62 and passes through the yoke 64, the magnetic gap G14, the stator closest to the facing portion 66, the magnetism detection gap $G_d$, and the stator closest to the facing portion 67, the magnetic gap G24, and the yoke 65 in sequence and then returns to the magnet 62. Further, the magnetic flux β flows from the magnet 63 and passes through the yoke 64, the magnetic gap G14, the stator closest to the facing portion 66, the magnetism detection gap $G_d$, and the stator closest to the facing portion 67, the magnetic gap G24, and the yoke 65 in sequence and then returns to the magnet 63. When the magnetic fluxes α, β flow in this manner, magnetic flux slightly flows through the electromagnetic conversion device 54 and hence the voltage of output signal of the electromagnetic conversion device 54 varies from the voltage in the above-described ideal case.

In the case where the stators 52, 53 are shifted in position from each other as shown in FIG. 6A, when the pedal is totally closed, when the turning shaft 20 is shifted in position, because of the above-described principle, in the direction in which the urging force $F_s$ is applied, the magnetic field forming part 60 is relatively moved in the X direction with respect to the magnetism detecting part 50. This is because the X direction is defined along the direction in which the turning shaft 20 is shifted in position, that is, the urging force $F_s$ is applied. In this embodiment, since the facing portions 66, 67 are parallel to the X axis, even when the magnetic field forming part 60 is relatively moved in the X direction with respect to the magnetism detecting part 50, the widths of the magnetic gaps G14, G24 do not substantially vary. For this reason, the magnetic flux flowing through the electromagnetic conversion device 54 and by extension the voltage of output signal of the electromagnetic conversion device 54 do not substantially vary, either. Hence, it is possible to prevent the output signal of the turning angle sensor 5 from being varied by the position shift of turning shaft 20 irrespective of the accelerator pedal 2 being not turned.

As described above, according to the first embodiment, even when the plastic deformation develops in the turning shaft 20 and/or the bearing 3 to shift the position of the turning shaft 20, it is possible to prevent the output signal of the turning angle sensor 5 from varying. Hence, the ECU can exactly determine the turning angle of the accelerator pedal 2 on the basis of the output signal of the turning angle sensor 5. Therefore, this can improve also the control accuracy of the throttle by the ECU.

Accelerators in accordance with the second embodiment to the seventh embodiment of the invention will be described with reference to FIGS. 7 to 12.

Figure 7:
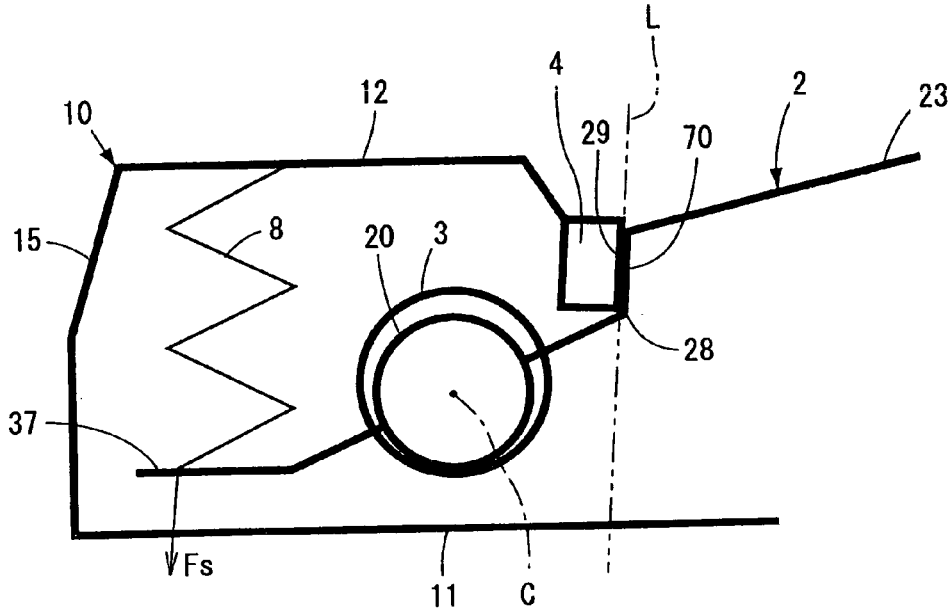
FIG. 7 is a side schematic view of an accelerator in accordance with a second embodiment of the present invention.

In an accelerator in accordance with the second embodiment, as shown in FIG. 7, the tip surface of the stopper 4 is formed in the shape of a flat surface 70. When the pedal is totally closed, a contour in the section vertical to axis of the flat surface 70 overlaps an imaginary straight line L along the direction in which the urging force $F_s$ is applied to the retaining portion 37. In the flat surface 70 like this, the stopper 4 is put into surface contact with the flat surface 29 of the abutting portion 28, so when the pedal is totally closed, the stopper 4 can guide the abutting portion 28 along the direction in which the urging force $F_s$ is applied.

Figure 8:
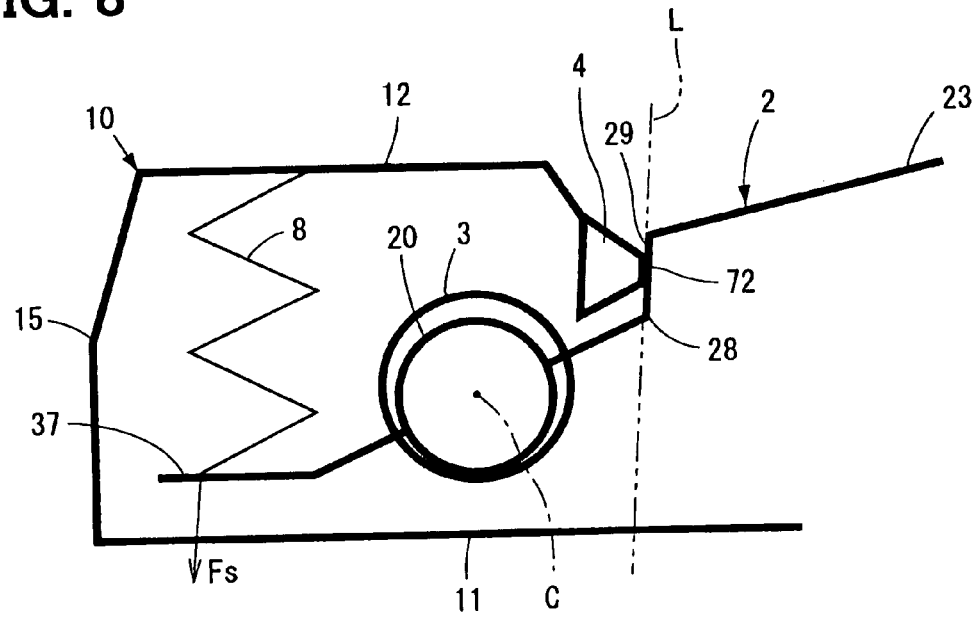
FIG. 8 is a side schematic view of an accelerator in accordance with a third embodiment of the present invention.

In an accelerator in accordance with the third embodiment, as shown in FIG. 8, the stopper 4 is formed in the shape tapered toward its protruding side and its tip surface is formed in the shape of a flat surface 72. When the pedal is totally closed, a contour in the section vertical to axis of the flat surface 72 overlaps an imaginary straight line L along the direction in which the urging force $F_s$ is applied to the retaining portion 37. In the flat surface 72 like this, the stopper 4 is put into surface contact with the flat surface 29 of the abutting portion 28, so when the pedal is totally closed, the stopper 4 can guide the abutting portion 28 along the direction in which the urging force $F_s$ is applied. Further, in the third embodiment, the stopper 4 forming the flat surface 72 is tapered toward the flat surface 72, so the contact area between the stopper 4 and the abutting portion 28 becomes comparatively small.

Figure 9:
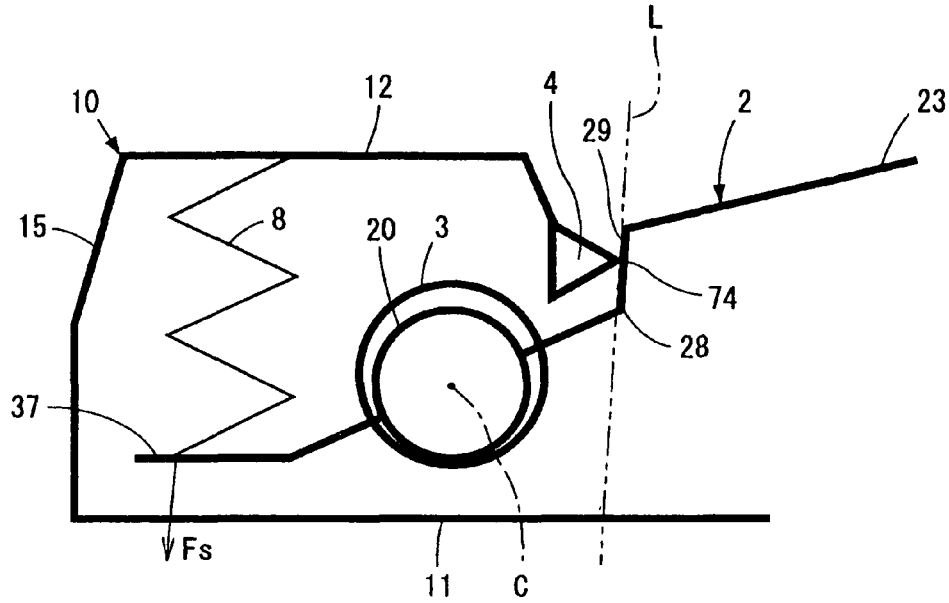
FIG. 9 is a side schematic view of an accelerator in accordance with a fourth embodiment of the present invention.

In an accelerator in accordance with the fourth embodiment, as shown in FIG. 9, the stopper 4 is formed in the shape tapered toward its protruding side. A tip 74 is pointed in such a way that a contour in the section vertical to axis is formed in an angular shape. In this pointed tip 74, the stopper 4 is put into surface contact with the flat surface 29 of the abutting portion 28, so the contact area between the stopper 4 and the abutting portion 28 becomes small. Also in the fourth embodiment like this, when the pedal is totally closed, the stopper 4 can guide the abutting portion 28 along the direction in which the urging force $F_s$ is applied.

Figure 10:
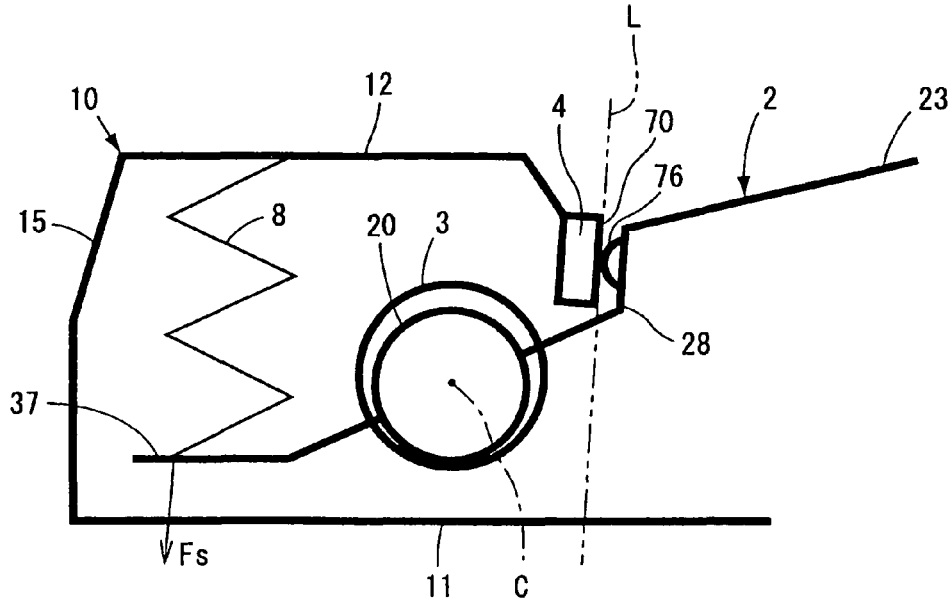
FIG. 10 is a side schematic view of an accelerator in accordance with a fifth embodiment of the present invention.

In an accelerator in accordance with the fifth embodiment, as shown in FIG. 10, the tip surface of the stopper 4 is formed in the shape of the same flat surface 70 as in the second embodiment. Further, the abutting portion 28 is formed convexly toward the stopper 4 and has a curved convex surface 76 whose contour in the section vertical to axis is circular. In this curved convex surface 76, the abutting portion 28 is put into line contact with the flat surface 70 of the stopper 4, so when the pedal is totally closed, the stopper 4 can guide the abutting portion 28 along the direction in which the urging force $F_s$ is applied.

Figure 11:
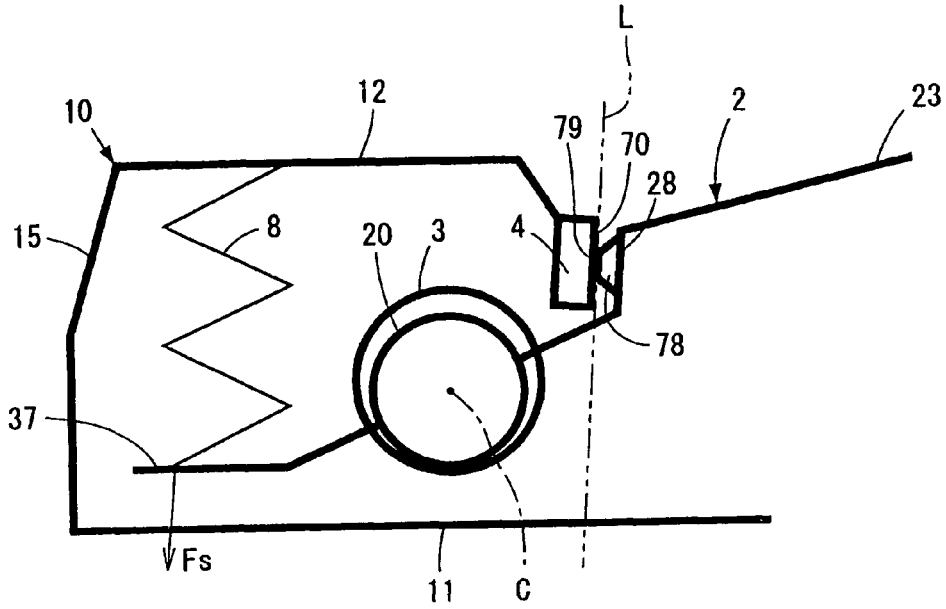
FIG. 11 is a side schematic view of an accelerator in accordance with a sixth embodiment of the present invention.

In an accelerator in accordance with the sixth embodiment, as shown in FIG. 11, the tip surface of the stopper 4 is formed in the shape of the same flat surface 70 as shown in the second embodiment. Further, the abutting portion 28 has a flat surface 79 at the tip surface of a portion 78 tapered toward the stopper 4. When the pedal is totally closed, a contour in the section vertical to axis of the flat surface 79 overlaps an imaginary straight line L along the direction in which the urging force $F_s$ is applied to the retaining portion 37. In the flat surface 79 like this, the abutting portion 28 is put into surface contact with the flat surface 70 of the stopper 4, so when the pedal is totally closed, the stopper 4 can guide the abutting portion 28 along the direction in which the urging force $F_s$ is applied. Further, in the sixth embodiment, the portion 78 forming the flat surface 79 is tapered toward the flat surface 79, so the contact area between the stopper 4 and the abutting portion 28 becomes comparatively small.

Figure 12:
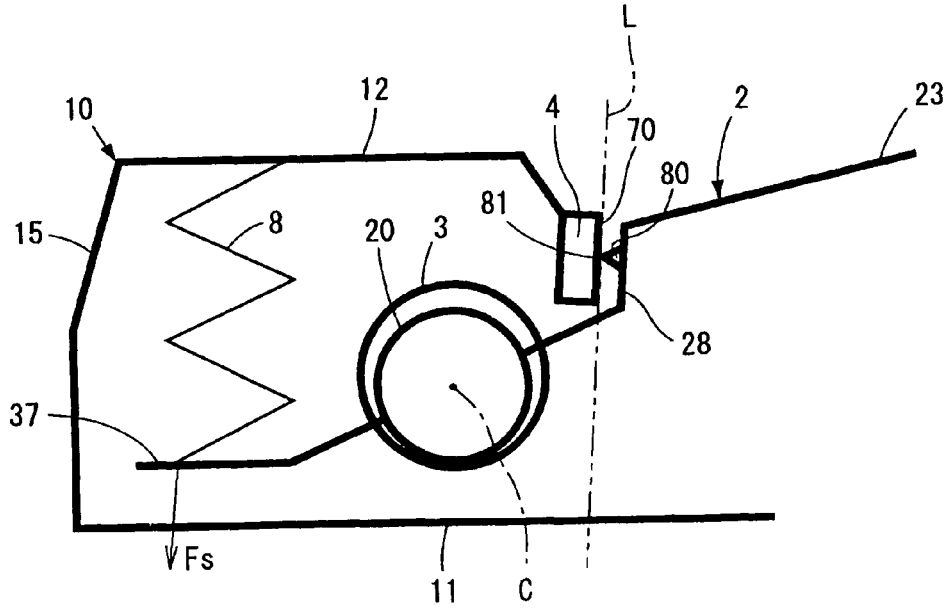
FIG. 12 is a side schematic view of an accelerator in accordance with a seventh embodiment of the present invention.

In an accelerator in accordance with the seventh embodiment, as shown in FIG. 12, the tip surface of the stopper 4 is formed in the shape of the same flat surface 70 as shown in the second embodiment. Further, in the abutting portion 28, the tip 81 of a portion 80 tapered toward the stopper 4 is pointed in such a way that a contour in the section vertical to axis is formed in an angular shape. In this pointed tip 81, the stopper 4 is put into surface contact with the flat surface 70 of the abutting portion 28, so the contact area between the stopper 4 and the abutting portion 28 becomes small. Also in the seventh embodiment like this, when the pedal is totally closed, the stopper 4 can guide the abutting portion 28 along the direction in which the urging force $F_s$ is applied.

Accelerators in accordance with the eighth and ninth embodiments of the invention will be described with reference to FIG. 13 and FIG. 14.

Figure 13:
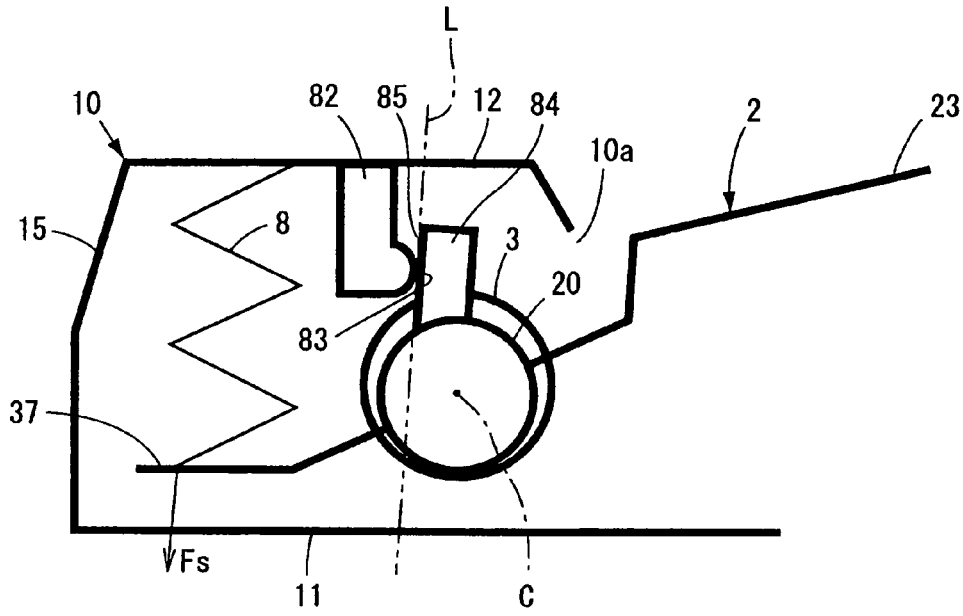
FIG. 13 is a side schematic view of an accelerator in accordance with a eighth embodiment of the present invention.

In the accelerator in accordance with the eighth embodiment, as shown in FIG. 13, a stopper 82 is formed integrally with the inner wall of the top plate 12 and is protruded toward the bottom plate 11 from a portion between the double coil spring 8 and the opening 10*a* in this inner wall. This stopper 82 has a curved convex surface 83 which is convex toward the opening 10*a* and whose contour in the section vertical to axis is circular. Further, in the accelerator in accordance with the eighth embodiment, an abutting portion 84 is formed integrally with the side walls 24, 25 of the pedal arm 21 and is protruded toward the outer periphery from a portion close to the turning shaft 20 in these side walls 24, 25. In particular, the direction in which the abutting portion 84 is protruded in the eighth embodiment is set at the direction toward the top plate 12 from the sidewalls 24, 25. The abutting portion 84 has a flat surface 85 facing the stopper 82. In this flat surface 85, the abutting portion 84 is put into line contact with the curved convex surface 83 of the stopper 82, so the contact area between the stopper 82 and the abutting portion 28 becomes small. When the pedal is totally closed, a contour in the section vertical to axis of the flat surface 85 overlaps an imaginary straight line L along the direction in which the urging force $F_s$ is applied to the retaining portion 37. Hence, when the pedal is totally closed, the stopper 82 can guide the abutting portion 84 along the direction in which the urging force $F_s$ is applied.

Figure 14:
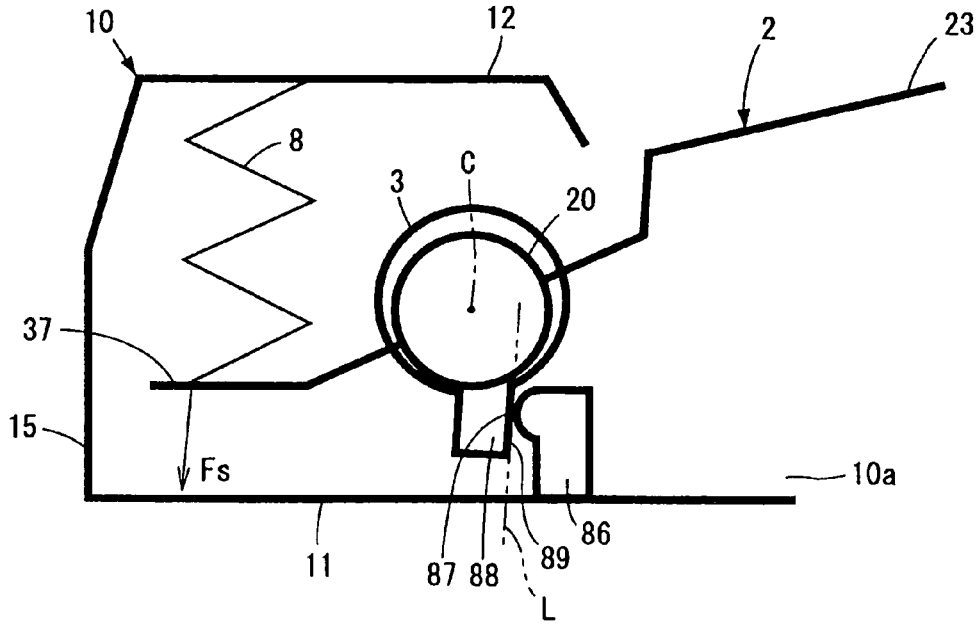
FIG. 14 is a side schematic view of an accelerator in accordance with a ninth embodiment of the present invention.

In an accelerator in accordance with the ninth embodiment, as shown in FIG. 14, a stopper 86 is formed integrally with the inner wall of the bottom plate 11 and is protruded toward the top plate 12 from a portion between the coupling plate 15 and the opening 10*a* in this inner wall. This stopper 86 has a curved convex surface 87 which is convex toward the coupling plate 15 and whose contour in the section vertical to axis is circular. Further, in the accelerator in accordance with the ninth embodiment, an abutting portion 88 is formed integrally with the sidewalls 24, 25 of the pedal arm 21 and is protruded to the outer periphery from a portion close to the turning shaft 20 in these sidewalls 24, 25. However, the direction in which the abutting portion 88 is protruded in the ninth embodiment is set at the direction toward the bottom plate 11 from the sidewalls 24, 25. The abutting portion 88 has a flat surface 89 facing the stopper 86. In this flat surface 89, the abutting portion 88 is put into line contact with the curved convex surface 87 of the stopper 86, so the contact area between the stopper 86 and the abutting portion 28 becomes small. When the pedal is totally closed, a contour in the section vertical to axis of the flat surface 89 overlaps an imaginary straight line L along the direction in which the urging force $F_s$ is applied to the retaining portion 37. Hence, when the pedal is totally closed, the stopper 86 can guide the abutting portion 88 along the direction in which the urging force $F_s$ is applied.

Figure 15:
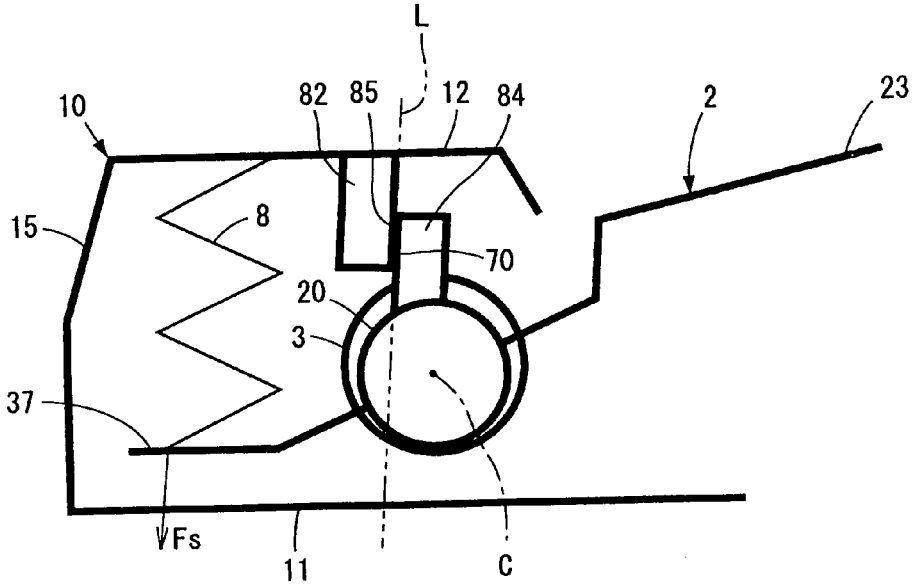
FIG. 15 is a side schematic view of a first modified version of the accelerator of the eighth embodiment of the present invention.
Figure 16:
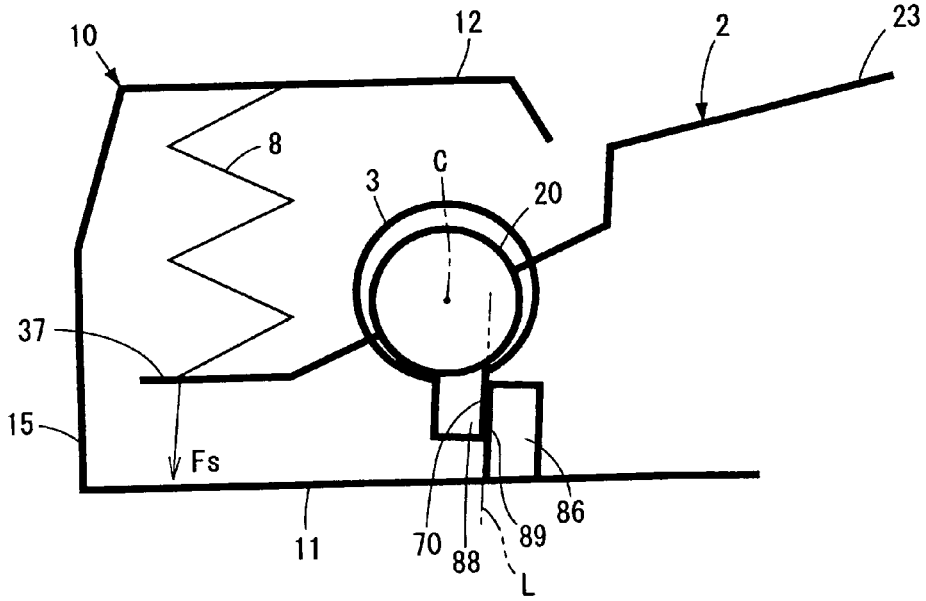
FIG. 16 is a side schematic view of a first modified version of the accelerator of the ninth embodiment of the present invention.
Figure 17:
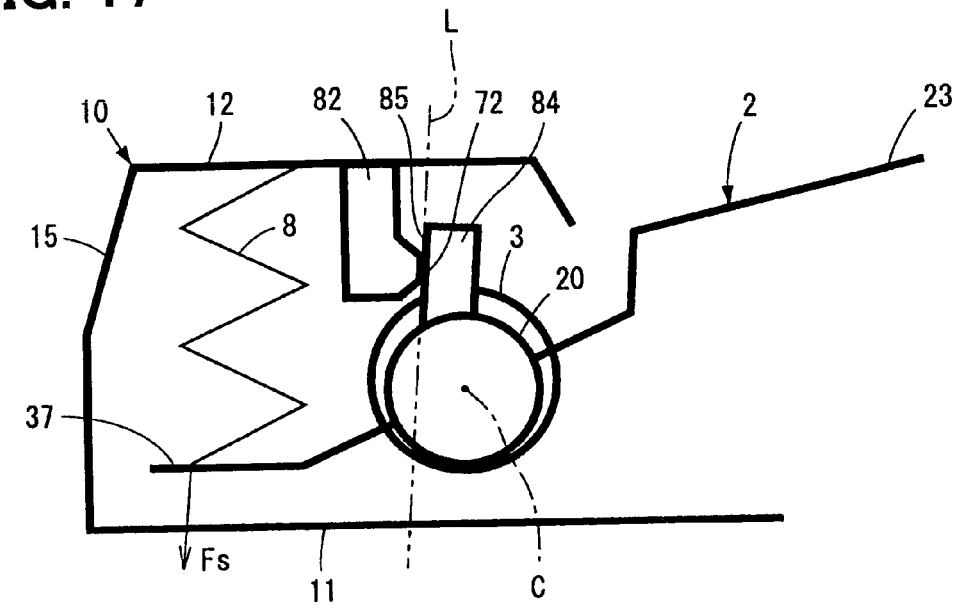
FIG. 17 is a side schematic view of a second modified version of the accelerator of the eighth embodiment of the present invention.
Figure 18:
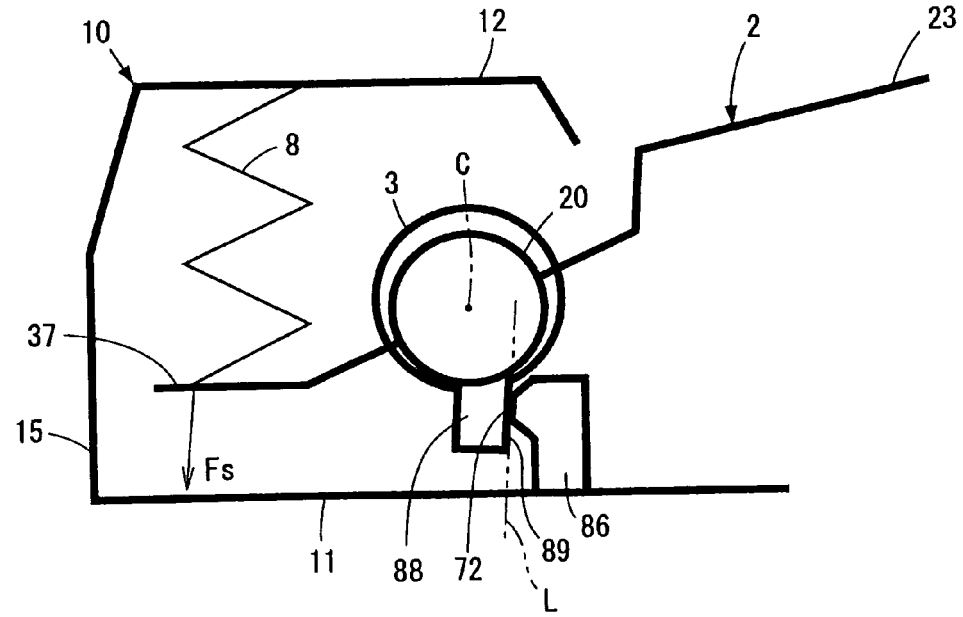
FIG. 18 is a side schematic view of a second modified version of the accelerator of the ninth embodiment of the present invention.
Figure 19:
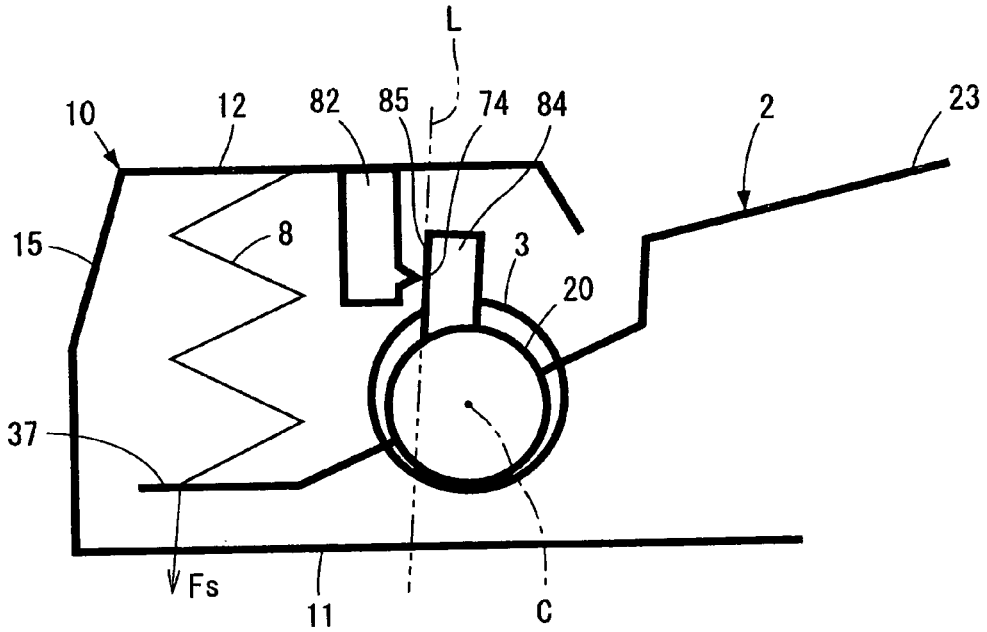
FIG. 19 is a side schematic view of a third modified version of the accelerator of the eighth embodiment of the present invention.
Figure 20:
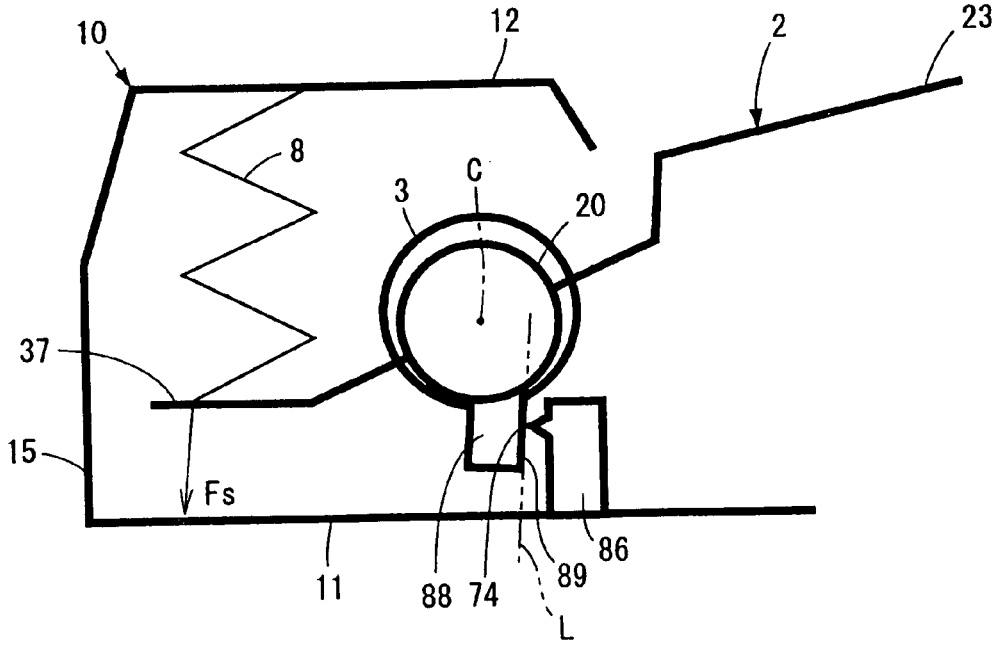
FIG. 20 is a side schematic view of a third modified version of the accelerator of the ninth embodiment of the present invention.
Figure 21:
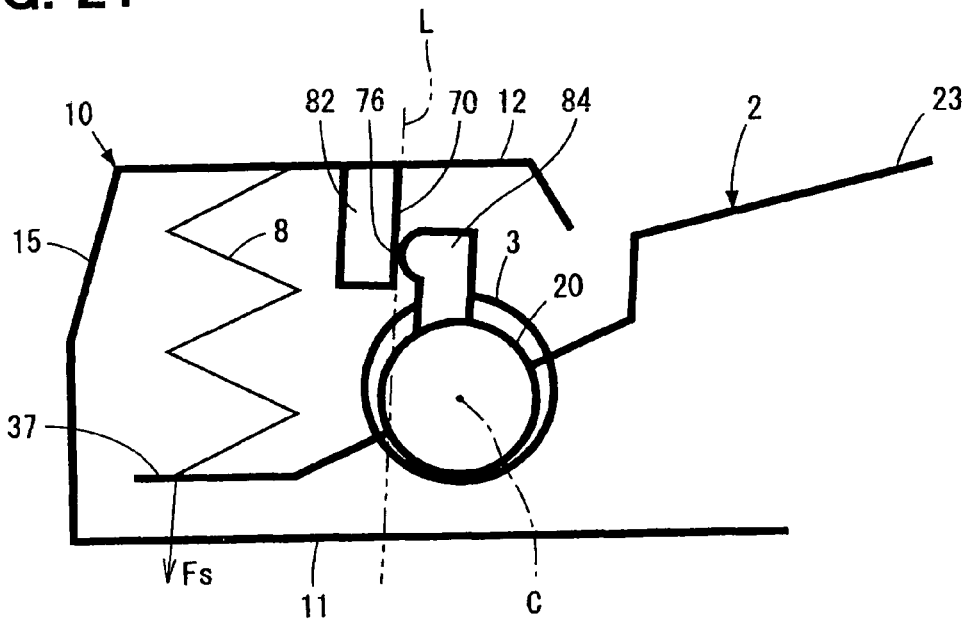
FIG. 21 is a side schematic view of a fourth modified version of the accelerator of the eighth embodiment of the present invention.
Figure 22:
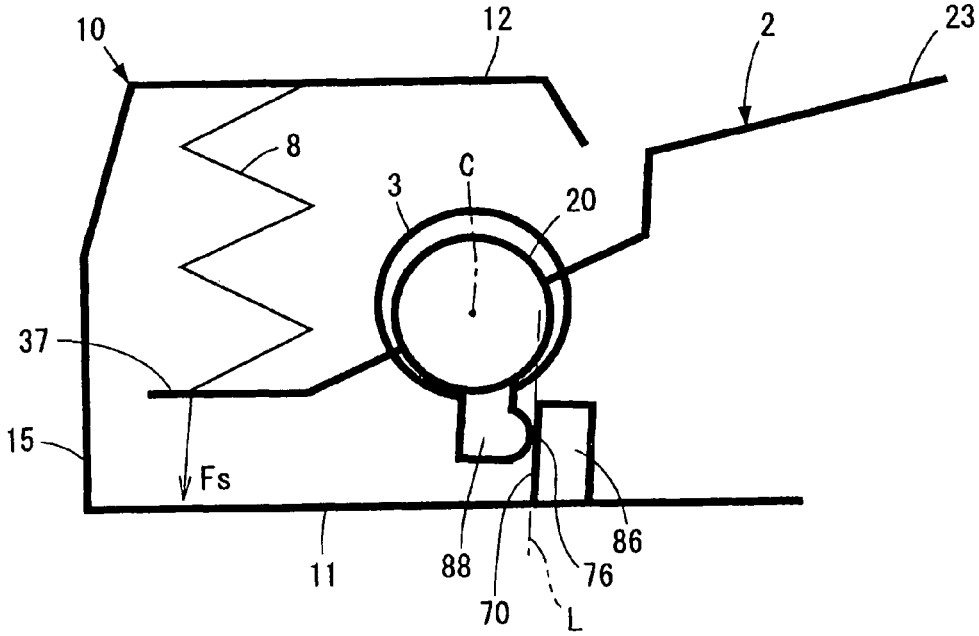
FIG. 22 is a side schematic view of a fourth modified version of the accelerator of the ninth embodiment of the present invention.
Figure 23:
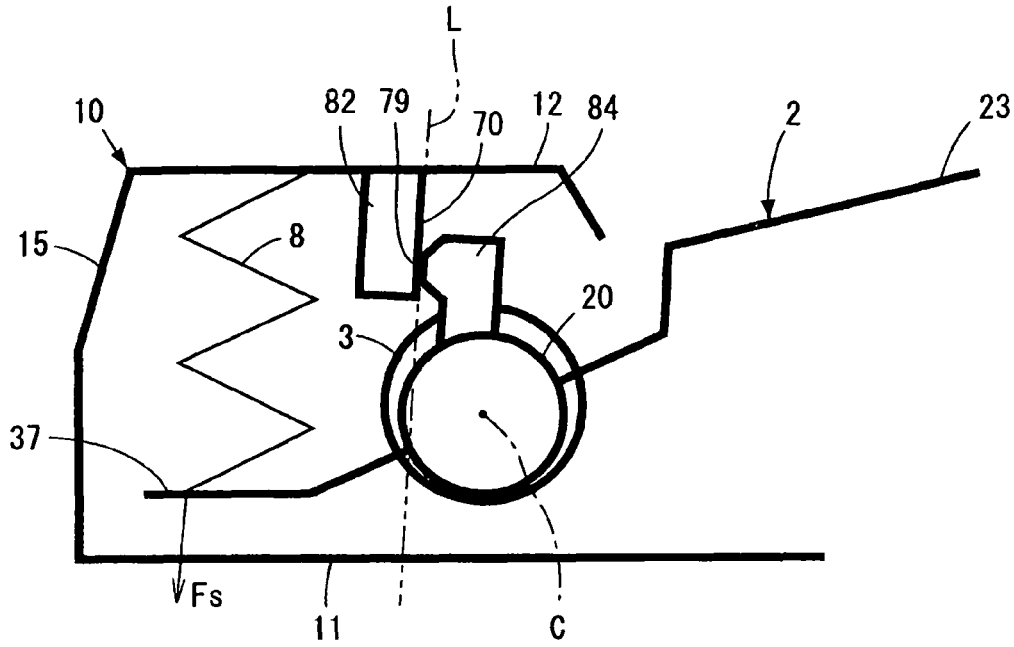
FIG. 23 is a side schematic view of a fifth modified version of the accelerator of the eighth embodiment of the present invention.
Figure 24:
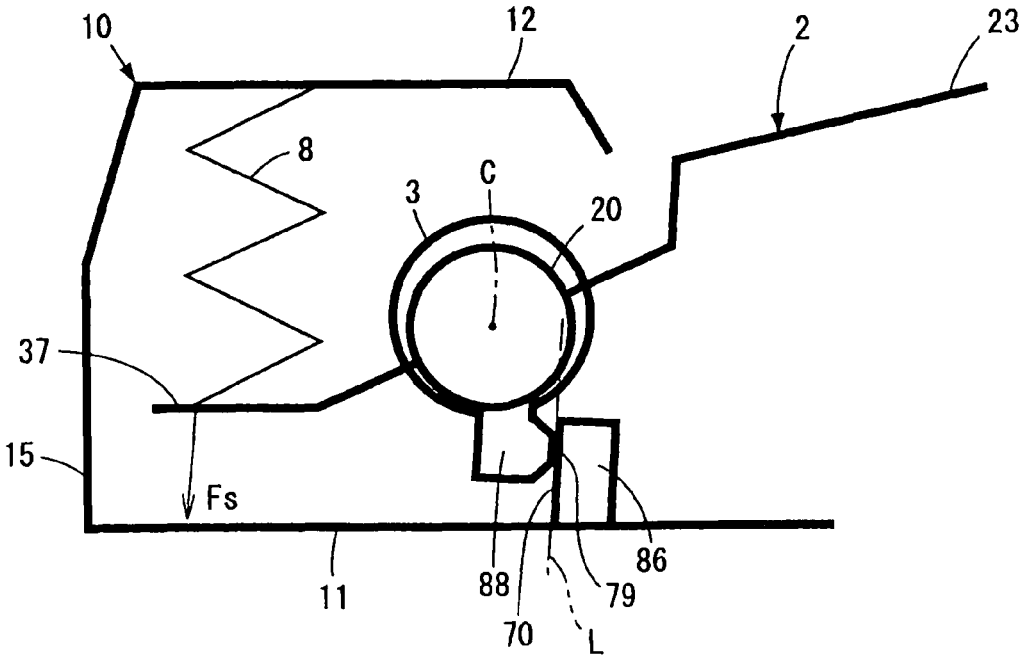
FIG. 24 is a side schematic view of a fifth modified version of the accelerator of the ninth embodiment of the present invention.
Figure 25:
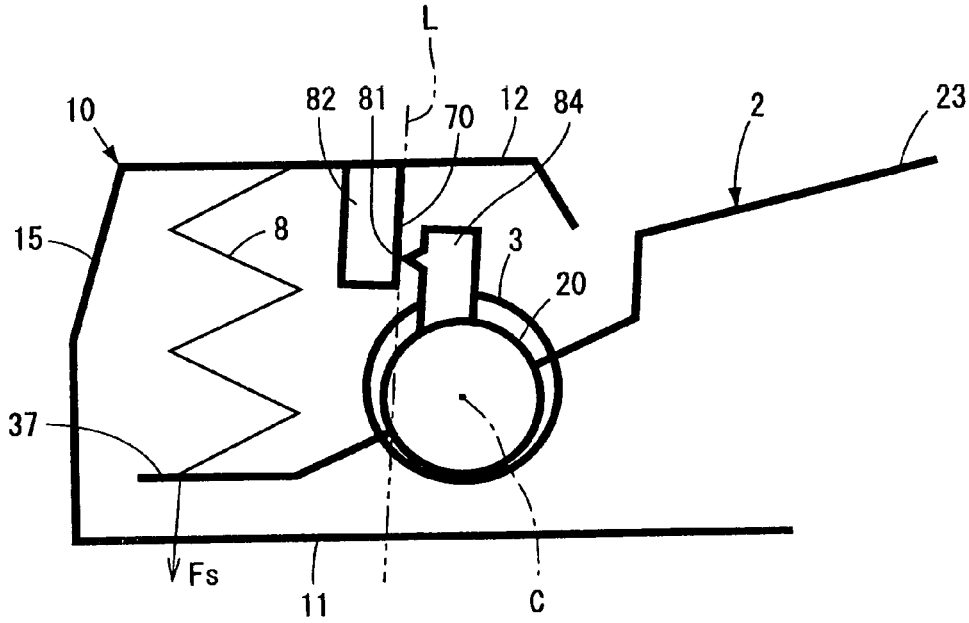
FIG. 25 is a side schematic view of a sixth modified version of the accelerator of the eighth embodiment of the present invention.
Figure 26:
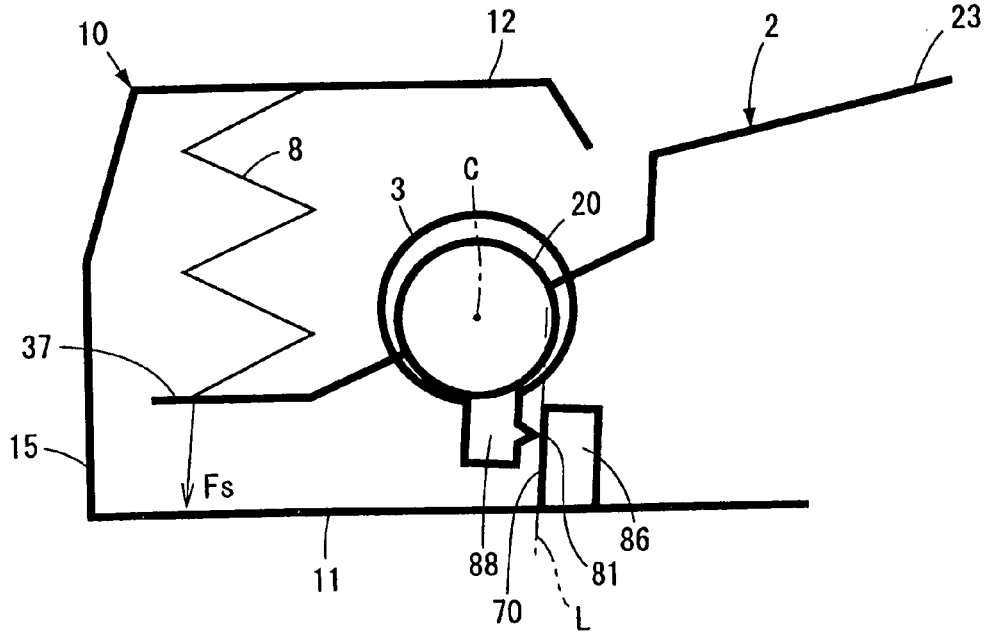
FIG. 26 is a side schematic view of a sixth modified version of the accelerator of the ninth embodiment of the present invention.

In the eighth and ninth embodiments, as shown in FIG. 15 and FIG. 16, in place of the curved convex surfaces 83, 87, the same flat surface 70 as in the second embodiment may be formed, or as shown in FIG. 17 and FIG. 18, in place of the curved convex surfaces 83, 87, the same flat surface 72 formed of a tapered tip surface as in the third embodiment may be formed. Further, in the eighth and ninth embodiments, as shown in FIG. 19 and FIG. 20, in place of the curved convex surfaces 83, 87, the same pointed tip 74 formed in an angular shape as in the fourth embodiment may be formed, or as shown in FIG. 21 and FIG. 22, in place of the curved convex surfaces 83, 87 and the flat surfaces 85, 89, the same flat surface 70 and curved convex surface 76 as in the fifth embodiment may be formed. Still further, in the eighth and ninth embodiments, as shown in FIG. 23 and FIG. 24, in place of the curved convex surfaces 83, 87 and the flat surfaces 85, 89, the same flat surface 70 and flat surface 79 formed of a tapered tip surface as in the sixth embodiment may be formed, or as shown in FIG. 25 and FIG. 26, in place of the curved convex surfaces 83, 87 and the flat surface 85, 89, the flat surface 70 and pointed tip 81 formed in an angular shape as in the seventh embodiment may be formed.

Figure 27:
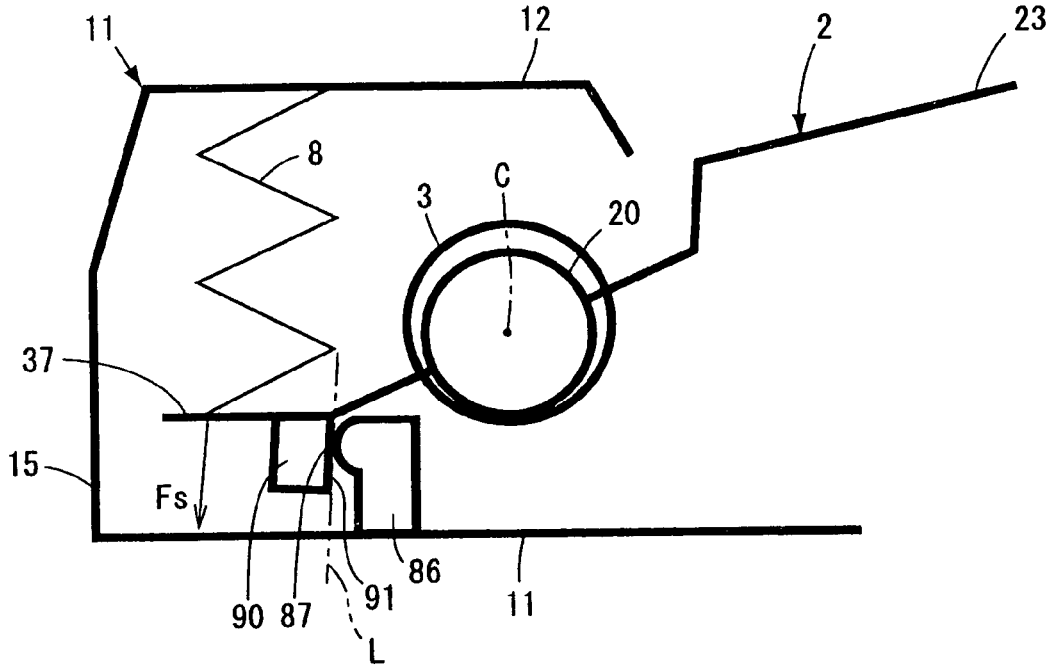
FIG. 27 is a side schematic view of an accelerator in accordance with a tenth embodiment of the present invention.
Figure 28A:
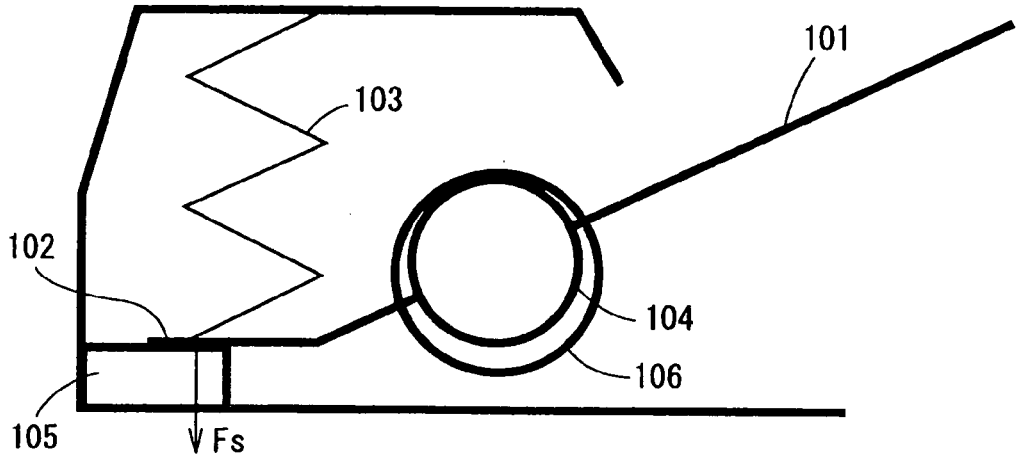
FIG. 28A PRIOR ART
FIG. 28A is a side schematic view of a conventional accelerator in a first position.
Figure 28B:
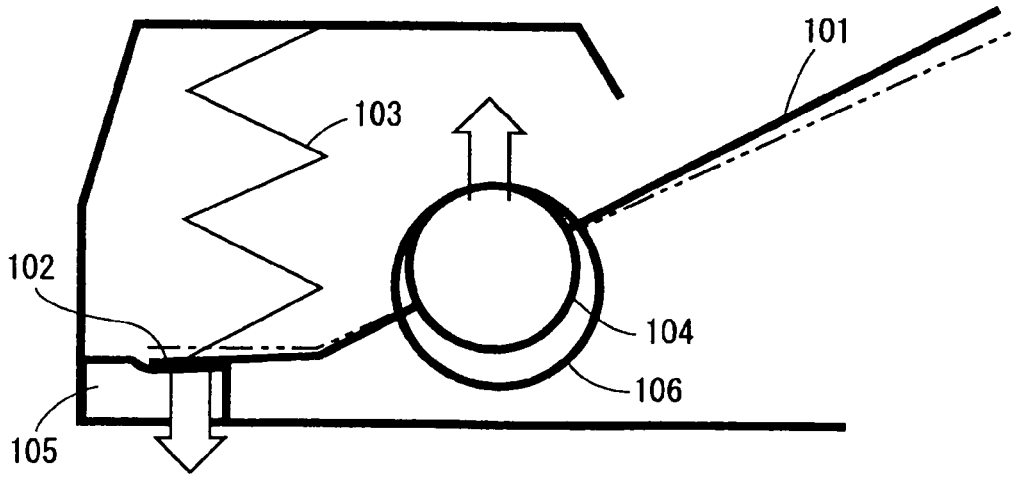
FIG. 28B PRIOR ART
FIG. 28B is a side schematic view of a conventional accelerator in a second position.
Figure 29A:
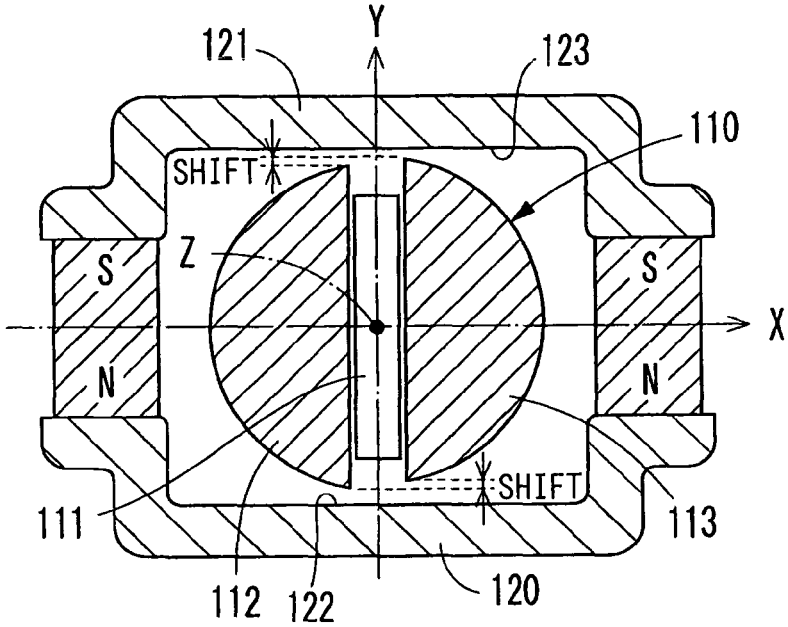
FIG. 29A PRIOR ART
FIG. 29A is a cross-sectional view of a turning angle sensor of a conventional accelerator.
Figure 29B:
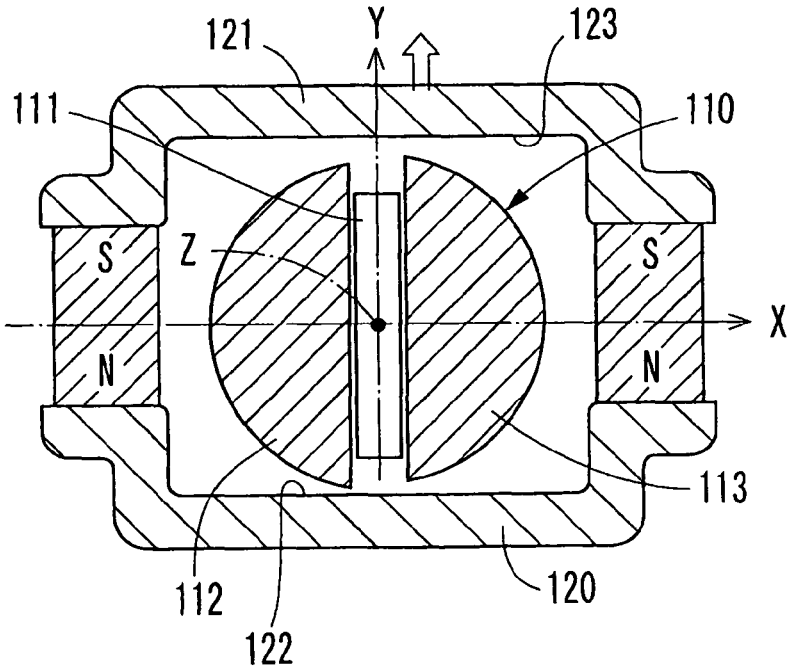
FIG. 29B PRIOR ART
FIG. 29B is a cross-sectional view of a turning angle sensor of a conventional accelerator.

An accelerator in accordance with the tenth embodiment will be described with reference to FIG. 27.

In the accelerator in accordance with the tenth embodiment, there is provided the stopper 86 having the same curved convex surface 87 as in the ninth embodiment. Further, in the accelerator in accordance with the tenth embodiment, an abutting portion 90 is formed integrally with the retaining portion 37 of the pedal rotor 22 and is protruded toward the bottom plate 11 from the plate surface 37*b* of the retaining portion 37. The abutting portion 90 has a flat surface 91 facing the stopper 86 formed thereon. In this flat surface 91, the abutting portion 90 is put into surface contact with the curved convex surface 87 of the stopper 86, so the contact area between the stopper 86 and the abutting portion 90 becomes small. When the pedal is totally closed, the contour in the section vertical to axis of the flat surface 91 overlaps an imaginary straight line L along the direction in which the urging force $F_s$ is applied to the retaining portion 37. Hence, when the pedal is totally closed, the stopper 86 can guide the abutting portion 90 along the direction in which the urging force $F_s$ is applied.

In the tenth embodiment, in place of the curved convex surface 87, any one of the same flat surface 70 as in the second embodiment, the same flat surface 72 having a tapered tip surface as in the third embodiment, and the same pointed tip 74 formed in an angular shape as in the fourth embodiment may be formed. Further, in the tenth embodiment, in place of the curved convex surface 87 and the flat surface 91, any one of the same flat surface 70 and curved convex surface 76 as in the fifth embodiment, the flat surface 70 and the flat surface 79 having a tapered tip surface as in the sixth embodiment, and the flat surface 70 and the pointed tip 81 formed in the angular shape as in the seventh embodiment may be formed.

Up to this point, the invention has been described in terms of its plurality of preferred embodiments, but it should be understood that the invention is not limited to the plurality of embodiments.

For example, in the plurality of embodiments described above, the pedal arm 21 having the turning shaft 20 and the side plate 13 having the bearing 3 are formed of resin, whereby the accelerator is reduced in weight and cost and, at the same time, high detection accuracy is secured. In contrast to this, at least one of the pedal arm 21 and the bearing 3 may be formed of metal. Further, the stoppers 4, 82, 86 formed of resin in the plurality of embodiments described above may be formed of metal.

Further, in the plurality of embodiments described above, the accelerator pedal 2 is constructed of two parts of the pedal arm 21 and the pedal rotor 22, but the accelerator pedal 2 may be constructed of one part or three or more parts.

Still further, in the plurality of embodiments described above, the double coil spring 8 made of two compression coil springs are used as the urging part for applying an urging force to the accelerator pedal 2, but for example, a suitable number of parts such as tension coil spring and torsion coil spring may be used as the urging parts.

Still further, in the plurality of embodiments described above, as for the turning angle sensor 5, the magnetism detecting part 50 is fixed to the side plate 13 and the magnetic field forming part 60 is fixed to the turning shaft 20, but it is also recommended that the magnetism detecting part 50 be fixed to the turning shaft 20 and that the magnetic field forming part 60 be fixed to the side plate 13. In this case, the rectangular coordinate system is a system fixed to the side plate 13.

Still further, in the plurality of embodiments described above, a combination of a Hall device and a signal processing circuit such as amplifier is used as the electromagnetic conversion device 54 of the turning angle sensor 5. In contrast to this, a combination of a magnetoresistance device and a signal processing circuit may be used as the electromagnetic conversion device 54 and a electromagnetic conversion device 54 constructed of only a Hall device or a magnetoresistance device may be used.

In addition, in the plurality of embodiments described above, the stopper 4 and the turning angle sensor 5 in accordance with the invention are used. In contrast to this, it is also recommended that in place of the stopper 4, for example, a publicly known stopper disclosed in patent document 1 be used and that a turning angle sensor 5 be used in which the X direction of a rectangular coordinate system when the pedal is totally closed is defined along the direction in which the turning shaft 20 is shifted in position in this case. Alternatively, it is also recommended that the stopper 4 according to the invention and a publicly known turning angle sensor 5 be used in combination.

What is claimed is:

1. An accelerator comprising:

a housing;

a bearing part fixed to the housing;

an urging part fixed to the housing;

an accelerator pedal that has a turning shaft supported by the bearing part and an abutting part, the turning shaft being turned forward when a depressing force is applied thereto and is turned reversely when an urging force of the urging part is applied thereto;

a stopper fixed to the housing to abut against the abutting part of the accelerator pedal to limit reverse turn of the accelerator pedal, the stopper providing a totally closed position of the accelerator pedal when abutting the abutting part of the accelerator pedal; and a turning angle sensor that is disposed between the turning shaft and the housing to detect a turning angle of the accelerator pedal, wherein one of the stopper and the abutting part has a guiding surface substantially parallel to a direction in which the urging force is applied so that the stopper and the abutting part abut each other at the guiding surface when the accelerator pedal is totally closed and so that when abutted, the stopper guides the abutting part to slide along the guiding surface;

wherein the turning angle detecting sensor comprises:

a magnetism detecting part that is fixed to the housing and provided with two first magnetic bodies arranged side by side in a first direction, and an electromagnetic conversion device sandwiched between the two first magnetic bodies; and a magnetic field forming part that is fixed to the turning shaft so as to rotate relative to the magnetism detecting part when the turning shaft turns and provided with two second magnetic bodies, and two permanent magnets, the second magnetic bodies having flat facing portions facing each other across the magnetism detecting part in a second direction perpendicular to the first direction, and wherein the first direction is along the direction in which the urging force is applied when the accelerator pedal is in the totally closed position.

2. The accelerator as claimed in claim 1, wherein the accelerator pedal further includes a first force receiving part that receives the depressing force, and a second force receiving part that is provided on a side opposite to the first force receiving part across the turning shaft and receives the urging force of the urging part, and wherein the abutting part is provided between the turning shaft and the first force receiving part.

3. The accelerator as claimed in claim 1, wherein the accelerator pedal further includes a first force receiving part that receives the depressing force, and a second force receiving part that is provided on a side opposite to the first force receiving part across the turning shaft and receives urging force of the urging part, and wherein the abutting part protrudes toward an outer periphery from near the turning shaft.

4. The accelerator of claim 1, wherein the stopper is put into line contact with the abutting part.

5. The accelerator of claim 1, wherein the stopper is put into surface contact with the abutting part.

6. The accelerator of claim 1, wherein the electromagnetic conversion device comprises a Hall device.

7. The accelerator of claim 1, wherein the electromagnetic conversion device comprises a magnetoresistance device.

8. The accelerator of claim 1, wherein the respective first magnetic bodies are formed in a same shape.

9. The accelerator of claim 1, wherein at least one of the bearing part and the turning shaft is formed of resin.

10. The accelerator as claimed in claim 1, wherein the accelerator pedal includes a first force receiving part that receives the depressing force, a second force receiving part that is provided on a side opposite to the first force receiving part across the turning shaft and receives the urging force of the urging part, and an abutting part that is provided between the turning shaft and the second force receiving part and abuts against the stopper at a predetermined turning angle.

11. An accelerator comprising:

a housing a bearing part fixed to the housing;

an urging part fixed to the housing;

an accelerator pedal that has a turning shaft supported by the bearing part and an abutting part, the turning shaft being turned forward when a depressing force is applied thereto and is turned reversely when an urging force of the urging part is applied thereto;

a stopper that abuts against the abutting part of the accelerator pedal to limit reverse turn of the accelerator pedal, the stopper providing a totally closed position of the accelerator pedal when abutting the abutting part of the accelerator pedal; and a turning angle sensor that detects a turning angle of the accelerator pedal, wherein:

the turning angle detecting sensor comprises:

a magnetism detecting part that is fixed to the housing and provided with two first magnetic bodies disposed in the housing and arranged side by side in a first direction, an electromagnetic conversion device sandwiched between the two first magnetic bodies; and a magnetic field forming part that is fixed to the turning shaft so as to rotate relative to the magnetism detecting part when the turning shaft turns and provided with two second magnetic bodies, the second magnetic bodies having flat facing portions facing each other across the magnetism detecting part in a second direction that is perpendicular to the first direction;

the stopper and the abutting portion are arranged to have a guiding surface extending in a direction in which the urging force is applied so that the stopper and the accelerator pedal abut each other at the guiding surface when the accelerator pedal is totally closed and so that when abutted, the stopper guides the abutting part to slide along the direction in which the urging force is applied; and the first direction is along the direction in which the urging force is applied when the accelerator pedal is in the totally closed position.

12. The accelerator of claim 11, wherein the electromagnetic conversion device comprises a Hall device.

13. The accelerator of claim 11, wherein the electromagnetic conversion device comprises a magnetoresistance device.

14. The accelerator of claim 11, wherein the respective first magnetic bodies are formed in a same shape.

15. The accelerator of claim 11, wherein one of the bearing part and the turning shaft is formed of resin.

* * * * *